US008933865B2

(12) United States Patent
Kishi

(10) Patent No.: US 8,933,865 B2
(45) Date of Patent: Jan. 13, 2015

(54) DISPLAY DEVICE AND DRIVE METHOD THEREFOR

(75) Inventor: Noritaka Kishi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 23 days.

(21) Appl. No.: 13/876,582

(22) PCT Filed: Oct. 17, 2011

(86) PCT No.: PCT/JP2011/073781

§ 371 (c)(1),
(2), (4) Date: Mar. 28, 2013

(87) PCT Pub. No.: WO2012/053462

PCT Pub. Date: Apr. 26, 2012

(65) Prior Publication Data

US 2013/0181969 A1 Jul. 18, 2013

(30) Foreign Application Priority Data

Oct. 21, 2010 (JP) ..... 2010-236209

(51) Int. Cl.
*G09G 3/30* (2006.01)
*G09G 3/32* (2006.01)

(52) U.S. Cl.
CPC ..... *G09G 3/3275* (2013.01); *G09G 3/3233* (2013.01); *G09G 2310/0283* (2013.01)
USPC ..... 345/76; 345/77; 345/78; 315/169.3

(58) Field of Classification Search
CPC ..... G06F 3/0412; G06F 3/0421; G06F 3/042; H04N 3/155; H04N 5/32; H04N 5/325; H04N 5/367; G09G 3/3233; G09G 2300/0819; G09G 2300/0861; G09G 2300/0842; G09G 2320/043; G09G 3/3291; G09G 2300/0866; G09G 2300/0852; G09G 2320/0252; G02F 1/136213; G02F 1/1362; G02F 1/136277; G02F 2001/13613
USPC ..... 345/76–84, 690, 204, 211
See application file for complete search history.

(56) References Cited

U.S. PATENT DOCUMENTS 8,217,862 B2 * 7/2012 Minami et al. ..... 345/76
8,232,986 B2 * 7/2012 Kim et al. ..... 345/213

(Continued)

FOREIGN PATENT DOCUMENTS

JP 2002-91376 A 3/2002
JP 2006-133731 A 5/2006

(Continued)

OTHER PUBLICATIONS

International Search Report received for PCT Patent Application No. PCT/JP2011/073781, mailed on Jan. 17, 2012, 5 pages (2 pages of English Translation and 3 pages of PCT Search Report).

(Continued)

*Primary Examiner* — Duc Dinh
(74) *Attorney, Agent, or Firm* — Morrison & Foerster LLP

(57) ABSTRACT

Provided is a display device that can sufficiently secure a period for threshold value detection with a simple configuration and that can inhibit occurrence of luminance non-uniformity. The display device includes a plurality of pixel circuits; a gate driver circuit connected to a plurality of scanning signal lines and a plurality of control lines; and a power control circuit connected to a plurality of power lines through a common power line. Each pixel circuit includes an organic EL element, a plurality of TFTs, and a capacitor. During each frame period, after initialization and threshold value detection are collectively performed on a plurality of rows, writing and light emission are performed sequentially on a row-by-row basis. Here, in a preceding frame (first frame) of two consecutive frame periods, writing is performed in order from the first row to the nth row (ascending order). In a subsequent frame (second frame) of the two frame periods, writing is performed in order from the nth row to the first row (descending order).

17 Claims, 27 Drawing Sheets

(56) References Cited

U.S. PATENT DOCUMENTS

| | | | | |
|---|---|---|---|---|
| 8,462,086 | B2 * | 6/2013 | Takasugi et al. | 345/78 |
| 8,743,029 | B2 * | 6/2014 | Tanikame et al. | 345/78 |
| 2001/0055828 | A1 | 12/2001 | Kaneko et al. | |
| 2006/0097966 | A1 | 5/2006 | Choi | |
| 2006/0290614 | A1 | 12/2006 | Nathan et al. | |
| 2007/0115225 | A1 | 5/2007 | Uchino et al. | |
| 2007/0268210 | A1 | 11/2007 | Uchino et al. | |
| 2008/0030436 | A1 | 2/2008 | Iida et al. | |
| 2008/0225027 | A1 * | 9/2008 | Toyomura et al. | 345/204 |
| 2009/0109146 | A1 * | 4/2009 | Minami et al. | 345/76 |
| 2009/0135111 | A1 | 5/2009 | Yamamoto et al. | |
| 2009/0207160 | A1 | 8/2009 | Shirasaki et al. | |
| 2009/0244055 | A1 | 10/2009 | Asano et al. | |
| 2009/0278771 | A1 | 11/2009 | Yamamoto et al. | |
| 2010/0007645 | A1 | 1/2010 | Ono | |
| 2010/0091207 | A1 | 4/2010 | Hasegawa et al. | |
| 2010/0149153 | A1 | 6/2010 | Yamamoto et al. | |
| 2011/0316892 | A1 | 12/2011 | Sung et al. | |

FOREIGN PATENT DOCUMENTS

| | | | |
|---|---|---|---|
| JP | 2006-215275 | A | 8/2006 |
| JP | 2007-148129 | A | 6/2007 |
| JP | 2007-156460 | A | 6/2007 |
| JP | 2007-310311 | A | 11/2007 |
| JP | 2007-316453 | A | 12/2007 |
| JP | 2008-33193 | A | 2/2008 |
| JP | 2008-051990 | A | 3/2008 |
| JP | 2009-133914 | A | 6/2009 |
| JP | 2009-192854 | A | 8/2009 |
| JP | 2009-237041 | A | 10/2009 |
| JP | 2010-054564 | A | 3/2010 |
| JP | 2010-145578 | A | 7/2010 |
| KR | 10-2012-0000887 | A | 1/2012 |
| WO | 2008/152817 | A1 | 12/2008 |

OTHER PUBLICATIONS

International Search Report received for PCT Application No. PCT/JP2011/062581, mailed on Aug. 30, 2011, 4 pages (2 pages of English Translation and 2 pages of Original Search Report).

Written Opinion received for PCT Application No. PCT/JP2011/062581, mailed on Aug. 30, 2011, 10 pages (6 pages of English Translation and 4 pages of Original Written Opinion).

* cited by examiner

DISPLAY DEVICE AND DRIVE METHOD THEREFOR

CROSS REFERENCE TO RELATED APPLICATIONS

This is a U.S. National Phase patent application of PCT/JP2011/073781, filed Oct. 17, 2011, which claims priority to Japanese Patent Application No. 2010-236209, filed Oct. 21, 2010, each of which is hereby incorporated by reference in the present disclosure in its entirety.

TECHNICAL FIELD

The present invention relates to a display device, and more specifically to a display device including current-driven self-luminous type display elements, such as an organic EL display, and a drive method therefor.

BACKGROUND ART

As a thin, high image quality, and low power consumption display device, conventionally, an organic EL (Electro Luminescence) display is known. In the organic EL display, a plurality of pixel circuits, each including an organic EL element which is a current-driven self-luminous type display element and a driving transistor for driving the organic EL element, are arranged in a matrix form.

Methods for controlling the amount of current flowing through a current-driven type display element, such as an organic EL element, are broadly classified into a constant-current type control method (or a current specified type drive method) in which a current to flow through the display element is controlled based on a current flowing through a data signal line; and a constant-voltage type control method (or a voltage specified type drive method) in which a current to flow through the display element is controlled based on a voltage applied to a data signal line. When an organic EL display is allowed to operate by the constant-voltage type control method, there is a need to compensate for variations in the threshold voltage of a driving transistor and a reduction in current (reduction in luminance) resulting from an increase in resistance caused by deterioration over time of an organic EL element. On the other hand, in the constant-current type control method, since the current value of a data signal is controlled such that a constant current flows through an organic EL element irrespective of the above-described threshold voltage and internal resistance of the organic EL element, normally, the above-described compensation is not required. However, with the constant-current type control method, the numbers of driving transistors and wiring lines increase over the constant-voltage type control method, reducing the aperture ratio. Hence, the constant-voltage type control method is widely adopted.

For a pixel circuit that performs the above-described compensation operation in a configuration adopting the constant-voltage type control method, various types of configurations are conventionally known. Japanese Patent Application Laid-Open No. 2006-215275 describes a pixel circuit 80 shown in FIG. 28. The pixel circuit 80 includes TFTs (Thin Film Transistors) 81 to 85, a capacitor 86, and an organic EL element 87. When writing is performed to the pixel circuit 80, first, the TFTs 82 and 84 are placed in an on state, by which the gate-source voltage of the TFT 85 (driving transistor) is initialized. Then, the TFT 84 and the TFT 83 are placed in an off state in turn, by which a threshold voltage of the TFT 85 is held in the capacitor 86. Then, a data potential is applied to a data line DTL and the TFT 81 is placed in an on state. By controlling the TFTs in this manner, variations in the threshold voltage of the TFT 85 and (a reduction in current resulting from) an increase in resistance caused by deterioration over time of the organic EL element 87 can be compensated for.

The pixel circuit 80 is connected to the data line DTL, four control lines WSL, AZL1, AZL2, and DSL, and three power lines (a Vofs wiring line, a Vcc wiring line, and a Vss wiring line). In general, the larger the number of wiring lines (particularly, control lines) connected to the pixel circuit, the more complicated the circuit becomes, increasing manufacturing costs. In view of this, Japanese Patent Application Laid-Open No. 2006-215275 describes the pixel circuit in which the source terminal of the TFT 82 or the TFT 84 is connected to the control line WSL. Japanese Patent Application Laid-Open No. 2007-316453 describes a pixel circuit in which the gate terminal of the TFT 82 is connected to a control line for a preceding row. By thus using a control line and a power line in a shared manner, the number of wiring lines can be reduced.

Japanese Patent Application Laid-Open No. 2007-310311 describes a pixel circuit 90 shown in FIG. 29. The pixel circuit 90 includes a TFT 91, a TFT 92, a capacitor 93, and an organic EL element 94. When writing is performed to the pixel circuit 90, first, the TFT 91 is placed in an on state. Then, an initialization potential is applied to a power line DSL, by which the initialization potential is provided to the anode terminal of the organic EL element 94. Then, by applying a power supply potential to the power line DSL, a threshold voltage of the TFT 92 (driving transistor) is held in the capacitor 93. Then, a data potential is applied to a data line DTL. By thus providing an initialization potential from the power line, variations in the threshold voltage of the TFT 92 can be compensated for with a small number of elements.

In addition, Japanese Patent Application Laid-Open No. 2007-148129 describes a pixel circuit in which an initialization potential is provided from a power line and a reference potential is provided from a data line. Furthermore, Japanese Patent Application Laid-Open No. 2008-33193 describes a pixel circuit that performs compensation operation (operation for compensating for variations in threshold voltage) during a plurality of horizontal periods before performing writing. Moreover, Japanese Patent Application Laid-Open No. 2009-237041 describes a display device in which a threshold voltage variation correction process is performed on a plurality of lines at one time and the scanning order for writing of a plurality of lines on which a variation correction process is performed simultaneously is reversed every field (frame).

PRIOR ART DOCUMENTS

Patent Documents

[Patent Document 1] Japanese Patent Application Laid-Open No. 2006-215275

[Patent Document 2] Japanese Patent Application Laid-Open No. 2007-316453

[Patent Document 3] Japanese Patent Application Laid-Open No. 2007-310311

[Patent Document 4] Japanese Patent Application Laid-Open No. 2007-148129

[Patent Document 5] Japanese Patent Application Laid-Open No. 2008-33193

[Patent Document 6] Japanese Patent Application Laid-Open No. 2009-237041

SUMMARY OF THE INVENTION

Problems to be Solved by the Invention

By applying the method described in Japanese Patent Application Laid-Open No. 2006-215275 or Japanese Patent Application Laid-Open No. 2007-316453 to the pixel circuit 80 shown in FIG. 28, the number of wiring lines connected to the pixel circuit can be reduced. However, the pixel circuit obtained by this method has a problem that the number of TFTs is large. On the other hand, in the pixel circuit 90 shown in FIG. 29, the number of TFTs is small. However, when the pixel circuit 90 is used, the power line DSL needs to be driven in conjunction with a control line WSL. Hence, a power control circuit requires the same number of output buffers as that of power lines DSL. In addition, since the potential of the power line DSL needs to be changed in a short period of time in accordance with the selection period of the control line WSL, the output buffers provided in the power control circuit require high current capability. Therefore, the pixel circuit 90 has a problem that the circuit size and power consumption of the power control circuit increase.

In addition, by applying the method described in Japanese Patent Application Laid-Open No. 2008-33193 or Japanese Patent Application Laid-Open No. 2009-237041, although a period required for compensation operation (also called threshold value detection) is sufficiently secured, the configuration becomes complex. On the other hand, if compensation operation is performed during a selection period like other conventional examples, even though the configuration can be simplified, a period required to detect a threshold voltage of a TFT is not sufficiently secured. Furthermore, even when a period for compensation operation is sufficiently secured, there is concern about the occurrence of luminance non-uniformity on a screen, depending on the timing of compensation operation or writing on a row-by-row basis.

An object of the present invention is therefore to provide a display device capable of sufficiently securing a period for threshold value detection with a simple configuration, and capable of inhibiting the occurrence of luminance non-uniformity.

Means for Solving the Problems

A first aspect of the present invention is directed to an active matrix-type display device comprising:

a plurality of pixel circuits arranged to form a matrix having a plurality of rows and a plurality of columns;

a plurality of video signal lines provided for the respective columns of the plurality of pixel circuits;

a plurality of scanning signal lines and a plurality of control lines provided for the respective rows of the plurality of pixel circuits;

a plurality of power lines provided to supply a power supply potential to the plurality of pixel circuits;

a column drive circuit that drives the plurality of video signal lines; and a row drive circuit that drives the plurality of scanning signal lines and the plurality of control lines selectively or collectively, wherein each of the pixel circuits includes:

an electro-optic element that emits light based on a current provided from the power line;

a driving transistor provided on a path of the current flowing through the electro-optic element;

a write control transistor that is provided between a control terminal of the driving transistor and the video signal line, and that electrically connects the control terminal of the driving transistor to the video signal line when the scanning signal line is activated by the row drive circuit;

a light emission control transistor that is provided between one conduction terminal of the driving transistor and the power line, and that electrically connects the one conduction terminal of the driving transistor to the power line when the control line is activated by the row drive circuit; and a capacitor provided between the control terminal of the driving transistor and the other conduction terminal of the driving transistor, and when focusing on each row group obtained when the plurality of rows are grouped into one or a plurality of row groups, the row drive circuit collectively activates all of scanning signal lines and control lines provided for respective rows belonging to the row group during an initialization period and a threshold value detection period, and selectively and sequentially activates the scanning signal lines provided for the respective rows belonging to the row group while selection order is reversed every k-frame period (k is a natural number), such that a write period for accumulating in the capacitors charge according to an image to be displayed is provided on a row-by-row basis, after the threshold value detection period, the initialization period being a predetermined period of time after start of a frame period and being a period for initializing the electro-optic element, and the threshold value detection period being a predetermined period of time after the initialization period and being a period for compensating for variations in the threshold voltage of the driving transistor.

According to a second aspect of the present invention, in the first aspect of the present invention, the k is 1.

According to a third aspect of the present invention, in the first aspect of the present invention, the display device further comprises a power control circuit that drives the plurality of power lines; and for each of the row groups, a common power line connected in a shared manner to a group of the plurality of power lines, wherein when focusing on each row group, the power control circuit provides an initialization potential, through a common power line corresponding to the row group, to power lines connected to the common power line during the initialization period, the initialization potential initializing the electro-optic element.

According to a fourth aspect of the present invention, in the third aspect of the present invention, the plurality of rows are grouped into a plurality of row groups.

According to a fifth aspect of the present invention, in the fourth aspect of the present invention, the plurality of rows are grouped such that a plurality of power lines belonging to a same row group are not adjacent to each other.

According to a sixth aspect of the present invention, in the fourth aspect of the present invention, the plurality of rows are grouped into three or more row groups.

According to a seventh aspect of the present invention, in the first aspect of the present invention, the display device further comprises, for each of the row groups, a common control line connected in a shared manner to a group of the plurality of control lines, wherein when focusing on each row group, the row drive circuit activates a common control line corresponding to the row group, such that electro-optic elements in pixel circuits of all rows belonging to the row group emit light at same timing after completion of a write period for all rows belonging to the row group.

According to an eighth aspect of the present invention, in the seventh aspect of the present invention, the plurality of rows are grouped into one row group.

According to a ninth aspect of the present invention, in the seventh aspect of the present invention, the plurality of rows are grouped into a plurality of row groups.

According to a tenth aspect of the present invention, in the seventh aspect of the present invention, the display device further comprises a power control circuit that drives the plurality of power lines; and for each of the row groups, a common power line connected in a shared manner to a group of the plurality of power lines, wherein when focusing on each row group, the power control circuit provides an initialization potential, through a common power line corresponding to the row group, to power lines connected to the common power line during the initialization period, the initialization potential initializing the electro-optic element.

According to an eleventh aspect of the present invention, in the tenth aspect of the present invention, the plurality of rows are grouped into a plurality of row groups.

According to a twelfth aspect of the present invention, in the eleventh aspect of the present invention, the plurality of rows are grouped such that a plurality of power lines belonging to a same row group are not adjacent to each other.

According to a thirteenth aspect of the present invention, in the eleventh aspect of the present invention, the plurality of rows are grouped into three or more row groups.

According to a fourteenth aspect of the present invention, in the first aspect of the present invention, when focusing on each row group, during a period after the threshold value detection period and before a first write period for rows belonging to the row group starts, the row drive circuit collectively activates all scanning signal lines provided for the respective rows belonging to the row group, and the column drive circuit applies a reverse bias potential to the plurality of video signal lines, the reverse bias potential placing the driving transistor in a reverse bias state.

A fifteenth aspect of the present invention is directed to a drive method for an active matrix-type display device including a plurality of pixel circuits arranged to form a matrix having a plurality of rows and a plurality of columns; a plurality of video signal lines provided for the respective columns of the plurality of pixel circuits; a plurality of scanning signal lines and a plurality of control lines provided for the respective rows of the plurality of pixel circuits; and a plurality of power lines provided to supply a power supply potential to the plurality of pixel circuits, the method comprising:

a column driving step of driving the plurality of video signal lines; and a row driving step of driving the plurality of scanning signal lines and the plurality of control lines selectively or collectively, wherein each of the pixel circuits includes:

an electro-optic element that emits light based on a current provided from the power line;

a driving transistor provided on a path of the current flowing through the electro-optic element;

a write control transistor that is provided between a control terminal of the driving transistor and the video signal line, and that electrically connects the control terminal of the driving transistor to the video signal line when the scanning signal line is activated in the row driving step;

a light emission control transistor that is provided between one conduction terminal of the driving transistor and the power line, and that electrically connects the one conduction terminal of the driving transistor to the power line when the control line is activated in the row driving step; and a capacitor provided between the control terminal of the driving transistor and the other conduction terminal of the driving transistor, and when focusing on each row group obtained when the plurality of rows are grouped into one or a plurality of row groups, in the row driving step, all of scanning signal lines and control lines provided for respective rows belonging to the row group are collectively activated during an initialization period and a threshold value detection period, and the scanning signal lines provided for the respective rows belonging to the row group are selectively and sequentially activated while selection order is reversed every k-frame period (k is a natural number), such that a write period for accumulating in the capacitors charge according to an image to be displayed is provided on a row-by-row basis, after the threshold value detection period, the initialization period being a predetermined period of time after start of a frame period and being a period for initializing the electro-optic element, and the threshold value detection period being a predetermined period of time after the initialization period and being a period for compensating for variations in the threshold voltage of the driving transistor.

According to a sixteenth aspect of the present invention, in the fifteenth aspect of the present invention, the k is 1.

According to a seventeenth aspect of the present invention, in the fifteenth aspect of the present invention, when focusing on each row group, during a period after the threshold value detection period and before a first write period for rows belonging to the row group starts, in the row driving step, all scanning signal lines provided for the respective rows belonging to the row group are collectively activated, and in the column driving step, a reverse bias potential is applied to the plurality of video signal lines, the reverse bias potential placing the driving transistor in a reverse bias state.

Effects of the Invention

According to the first aspect of the present invention, when focusing on each row group, an order of selecting the scanning signal lines (a scanning order) for writing to the capacitors in the pixel circuits is reversed every predetermined frame period. Hence, the length of the total period (standby period) from the time of completion of threshold value detection until the time of start of writing becomes substantially equal for all rows. Although leakage current may occur in a driving transistor or an electro-optic element during the standby period, the amount of movement of charge caused by the leakage current becomes substantially equal for all rows. As a result, the occurrence of luminance non-uniformity resulting from leakage current is suppressed. In addition, in each frame period, since initialization and threshold value detection of pixel circuits of all rows belonging to each row group are performed collectively, a sufficiently long initialization period and a sufficiently long threshold value detection period can be set. Hence, even when the power lines are driven by a circuit with relatively low drive capability, initialization operation can be reliably performed. In addition, since threshold value detection is reliably performed, the accuracy of compensation for variations in threshold voltage (threshold value compensation) can be improved. Furthermore, compared to a configuration in which threshold value detection is performed during a period of selecting a scanning signal line, a write period can be sufficiently secured.

According to the second aspect of the present invention, when focusing on each row group, the scanning order for writing to the capacitors in the pixel circuits is reversed every frame period. Hence, the occurrence of luminance non-uniformity resulting from leakage current in the driving transistor or the electro-optic element in the pixel circuit is effectively suppressed.

According to the third aspect of the present invention, a common power line is provided for each row group, and a power supply potential and an initialization potential are supplied to the power lines from the power control circuit through the common power lines. Hence, the number of output buffers to be provided in the power control circuit is smaller than the number of power lines. Thus, compared to a configuration in which the power lines are driven individually, the circuit size of the power control circuit can be reduced. In addition, since supply of the initialization potential is performed using the power lines, signal lines for supplying the initialization potential, or the like, become unnecessary and thus the number of elements in the pixel circuits can be reduced.

According to the fourth aspect of the present invention, initialization of the pixel circuits can be performed at suitable timing on a row-group-by-row-group basis.

According to the fifth aspect of the present invention, a difference in luminance occurring at the center of the screen can be prevented because the amounts of currents flowing through the plurality of common power lines are substantially the same, whereas a difference in luminance may occur at the center of the screen when there is a big difference in current flowing through power lines between the upper half of the screen and the lower half of the screen in the case in which the rows are grouped such that two adjacent power lines belong to the same row group.

According to the sixth aspect of the present invention, during a period in which pixel circuits of rows belonging to a given row group perform initialization and threshold value detection, pixel circuits of rows belonging to other two or more row groups perform light emission. Hence, the light emission period can be made relatively long.

According to the seventh aspect of the present invention, a common control line is provided for each row group, and the row drive circuit is electrically connected to each control line through a corresponding common control line. Hence, the number of pins (terminals) to be provided on a circuit for driving the control lines can be made smaller than the number of the control lines. In addition, pixel circuits of all rows belonging to one row group can be allowed to emit light at the same timing. Hence, the length of the period from the time of completion of threshold value detection until the time of start of light emission becomes equal for all rows belonging to each row group. By this, the magnitude of leakage current occurring in the driving transistor in the pixel circuit becomes substantially the same for all rows belonging to each row group. As a result, the occurrence of luminance non-uniformity resulting from leakage current in the driving transistor is suppressed.

According to the eighth aspect of the present invention, the size of a circuit for driving the control lines can be effectively reduced. In addition, since the pixel circuits of all rows can be allowed to emit light at the same timing, the occurrence of luminance non-uniformity resulting from leakage current in the driving transistor is effectively suppressed.

According to the ninth aspect of the present invention, the occurrence of luminance non-uniformity resulting from leakage current in the driving transistor is suppressed, and initialization of the pixel circuits can be performed at suitable timing on a row-group-by-row-group basis.

According to the tenth aspect of the present invention, in the display device configured to include a common control line for each row group, the same effect as that obtained in the third aspect of the present invention is obtained.

According to the eleventh aspect of the present invention, in the display device configured to include a common control line for each row group, the same effect as that obtained in the fourth aspect of the present invention is obtained.

According to the twelfth aspect of the present invention, in the display device configured to include a common control line for each row group, the same effect as that obtained in the fifth aspect of the present invention is obtained.

According to the thirteenth aspect of the present invention, in the display device configured to include a common control line for each row group, the same effect as that obtained in the sixth aspect of the present invention is obtained.

According to the fourteenth aspect of the present invention, in each pixel circuit, a reverse bias is applied to the control terminal of the driving transistor during the period from the time of completion of threshold value detection until the time when writing starts. Hence, a shift in the threshold characteristic of the driving transistor is suppressed. Here, the scanning signal lines are selectively and sequentially activated while the selection order is reversed every predetermined frame period. Hence, the cumulative time during which the reverse bias is applied to the control terminal of the driving transistor becomes substantially equal for the pixel circuits of all rows. As a result, a shift in the threshold characteristic of the driving transistor is suppressed without causing variations between rows.

According to the fifteenth aspect of the present invention, a drive method for a display device can bring about the same effect as that obtained in the first aspect of the present invention.

According to the sixteenth aspect of the present invention, a drive method for a display device can bring about the same effect as that obtained in the second aspect of the present invention.

According to the seventeenth aspect of the present invention, a drive method for a display device can bring about the same effect as that obtained in the fourteenth aspect of the present invention.

MODES FOR CARRYING OUT THE INVENTION

Embodiments of the present invention will be described below with reference to the accompanying drawings.

1. First Embodiment

1.1 Overall Configuration

Figure 2:
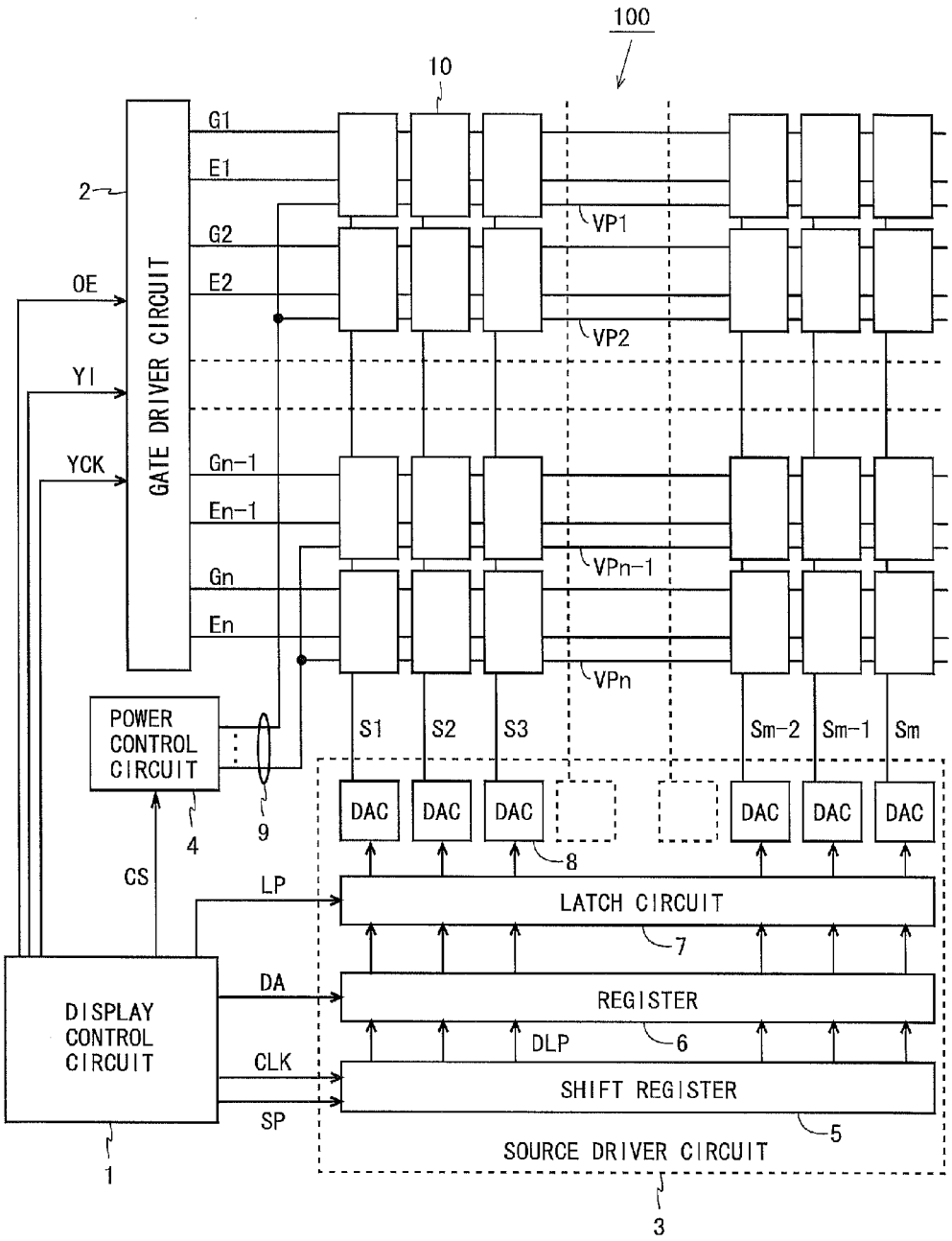
FIG. 2 is a block diagram showing an overall configuration of the display device in the first embodiment.

FIG. 2 is a block diagram showing an overall configuration of a display device according to a first embodiment of the present invention. A display device 100 shown in FIG. 2 is an organic EL display including a display control circuit 1, agate driver circuit 2, a source driver circuit 3, a power control circuit 4, and (m×n) pixel circuits 10. In the following, m and n are integers greater than or equal to 2, i is an integer between 1 and n inclusive, and j is an integer between 1 and m inclusive. In the present embodiment, a row drive circuit is implemented by the gate driver circuit 2, and a column drive circuit is implemented by the source driver circuit 3.

The display device 100 is provided with n scanning signal lines Gi parallel to one another and m data lines Sj parallel to one another and intersecting the scanning signal lines Gi. The (m×n) pixel circuits 10 are arranged in a matrix form at the respective intersections of the scanning signal lines Gi and the data lines Sj. In addition, n control lines Ei and n power lines VPi are provided parallel to the scanning signal lines Gi. Furthermore, common power lines 9 which are main wiring lines for current supply to connect the power control circuit 4 to the power lines VPi are provided. The scanning signal lines Gi and the control lines Ei are connected to the gate driver circuit 2, and the data lines Sj are connected to the source driver circuit 3. The power lines VPi are connected to the power control circuit 4 through the common power lines 9. A common potential Vcom is supplied to the pixel circuits 10 by a common electrode which is not shown. Herein, although the configuration is such that one end of each power line VPi is connected to a corresponding common power line 9, the configuration may be such that both ends (or three or more connecting points) of each power line VPi are connected to a corresponding common power line 9.

The display control circuit 1 outputs various types of control signals to the gate driver circuit 2, the source driver circuit 3, and the power control circuit 4. More specifically, the display control circuit 1 outputs a timing signal OE, a start pulse YI, and a clock YCK to the gate driver circuit 2, outputs a start pulse SP, a clock CLK, display data DA, and a latch pulse LP to the source driver circuit 3, and outputs a control signal CS to the power control circuit 4.

The gate driver circuit 2 includes a shift register circuit, a logic operation circuit, and a buffer. The shift register circuit sequentially transfers a start pulse YI in synchronization with the clock YCK. The logic operation circuit performs a logic operation between a pulse outputted from each stage of the shift register circuit and a timing signal OE. An output from the logic operation circuit is provided to a corresponding scanning signal line Gi and control line Ei through the buffer. A single scanning signal line Gi has m pixel circuits 10 connected thereto. The pixel circuits 10 are selected such that m pixel circuits 10 are selected collectively using a corresponding scanning signal line Gi. The timing signal OE may be composed of a plurality of signals, depending on the configuration of the logic operation circuit. It should be noted that, in the present embodiment, the gate driver circuit 2 includes a portion that functions as a scanning signal line drive circuit which drives the scanning signal lines Gi, and a portion that functions as a control line drive circuit which drives the control lines Ei.

The source driver circuit 3 includes an m-bit shift register 5, a register 6, a latch circuit 7, and m D/A converters 8. The shift register 5 has m cascade-connected registers, and transfers the start pulse SP supplied to the register of the first stage, in synchronization with the clock CLK, and outputs timing pulses DLP from the registers of the respective stages. Display data DA is supplied to the register 6 in accordance with the output timing of the timing pulses DLP. The register 6 stores the display data DA according to the timing pulses DLP. When display data DA for one row is stored in the register 6, the display control circuit 1 outputs a latch pulse LP to the latch circuit 7. When the latch circuit 7 receives the latch pulse LP, the latch circuit 7 holds the display data stored in the register 6. The D/A converters 8 are provided for the respective data lines Sj. The D/A converters 8 convert the display data held in the latch circuit 7 into analog voltages and apply the obtained analog voltages to the data lines Sj.

The power control circuit 4 has p output terminals for the respective p common power lines 9. The power control circuit 4 applies, based on a control signal CS, a power supply potential and an initialization potential to the common power lines 9 in a switching manner. When p=1, all of the power lines VPi are connected to a single common power line 9. In this case, the power control circuit 4 applies an initialization potential to the single common power line 9 at predetermined timing. When p≥2, the power lines VPi are divided into p groups, and power lines included in each group are connected to the same common power line 9. In this case, the power control circuit 4 applies an initialization potential to the p common power lines 9 at different timings. In the following, description is made assuming that the power supply potential is a high-level potential and the initialization potential is a low-level potential.

Figure 3:
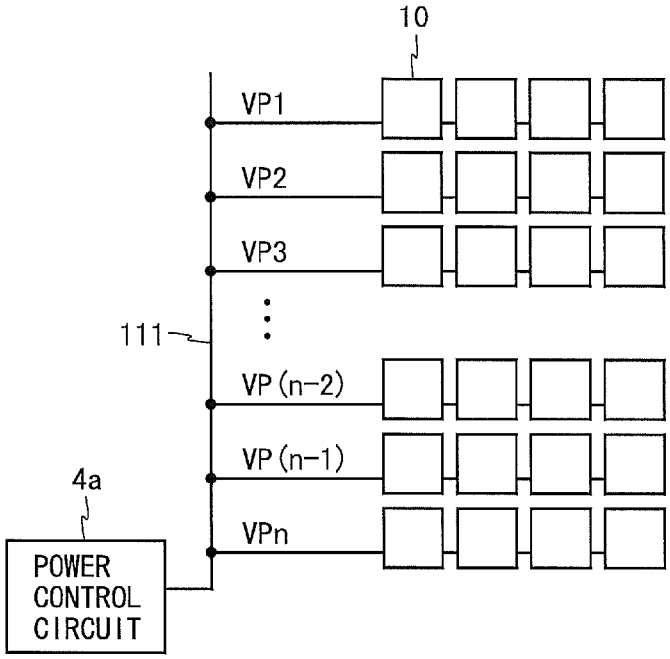
FIG. 3 is a diagram showing a connection form of power lines in the first embodiment.

Herein, first, the case of p=1 will be described as an example, and the case of p≥2 will be described later as variants (the case of p=2: a first variant and a second variant, and the case of p=3: a third variant). FIG. 3 is a diagram showing a connection form of power lines VPi in the present embodiment. As shown in FIG. 3, the display device 100 is provided with a single common power line 111 to connect a power control circuit 4*a* to the power lines VPi. One end of the common power line 111 is connected to one output terminal of the power control circuit 4*a*, and all of the power lines VPi are connected to the common power line 111. That is, in the present embodiment, one row group is formed by the first to the nth row. Note that, although the common power line 111 is described assuming that it is a main wiring line for current supply, the common power line 111 does not need to be a main wiring line, provided that the common power line 111 can connect all of the power lines VPi to the power control circuit 4*a* in a shared manner. Note also that, for the number of common power lines and the location of the connection between a common power line(s) and the power lines VPi, all known configurations can be applied.

1.2 Configuration of the Pixel Circuits

Figure 4:
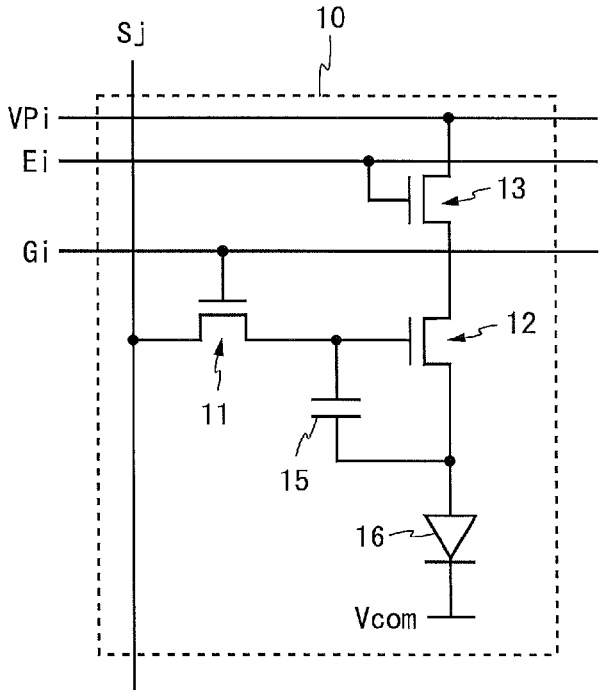
FIG. 4 is a circuit diagram showing a configuration of a pixel circuit in the first embodiment.

FIG. 4 is a circuit diagram showing a configuration of a pixel circuit 10. As shown in FIG. 4, the pixel circuit 10 includes TFTs 11 to 13, a capacitor 15, and an organic EL element 16. The TFTs 11 to 13 are all N-channel type transistors. The TFT 11 functions as a write control transistor. The TFT 12 functions as a driving transistor. The TFT 13 functions as a light emission control transistor. The organic EL element 16 functions as an electro-optic element.

In this specification, the electro-optic element refers to all elements whose optical characteristics are changed by providing electricity thereto, such as an FED (Field Emission Display), an LED, a charge-driven element, liquid crystal, and E ink (electronic ink), in addition to an organic EL element. Although in the following an organic EL element is exemplified as an electro-optic element, as long as the electro-optic element is a light emitting element whose amount of light emission is controlled according to the amount of current, the same description is possible.

As shown in FIG. 4, the pixel circuit 10 is connected to a scanning signal line Gi, a control line Ei, a data line Sj, a power line VPi, and an electrode having a common potential Vcom. The TFT 11 is connected at its one conduction terminal to the data line Sj, and is connected at its other conduction terminal to the gate terminal of the TFT 12. The TFT 13 is connected at its drain terminal to the power line VPi, and is connected at its source terminal to the drain terminal of the TFT 12. The source terminal of the TFT 12 is connected to the anode terminal of the organic EL element 16. The common potential Vcom is applied to the cathode terminal of the organic EL element 16. The capacitor 15 is provided between the gate and source terminals of the TFT 12. The gate terminal of the TFT 11 is connected to the scanning signal line Gi, and the gate terminal of the TFT 13 is connected to the control line Ei.

1.3 Drive Method

Figure 5:
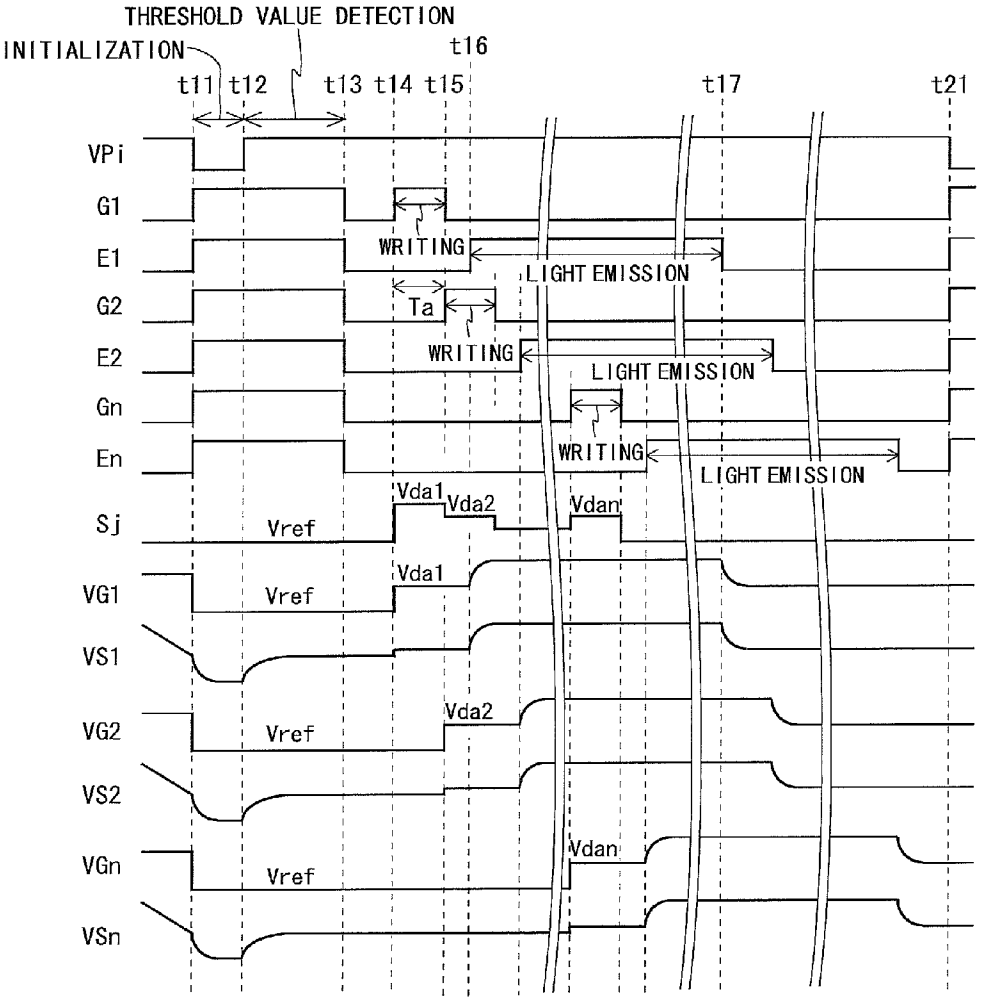
FIG. 5 is a timing chart (first frame) showing a method of driving the pixel circuits in the first embodiment.
Figure 6:
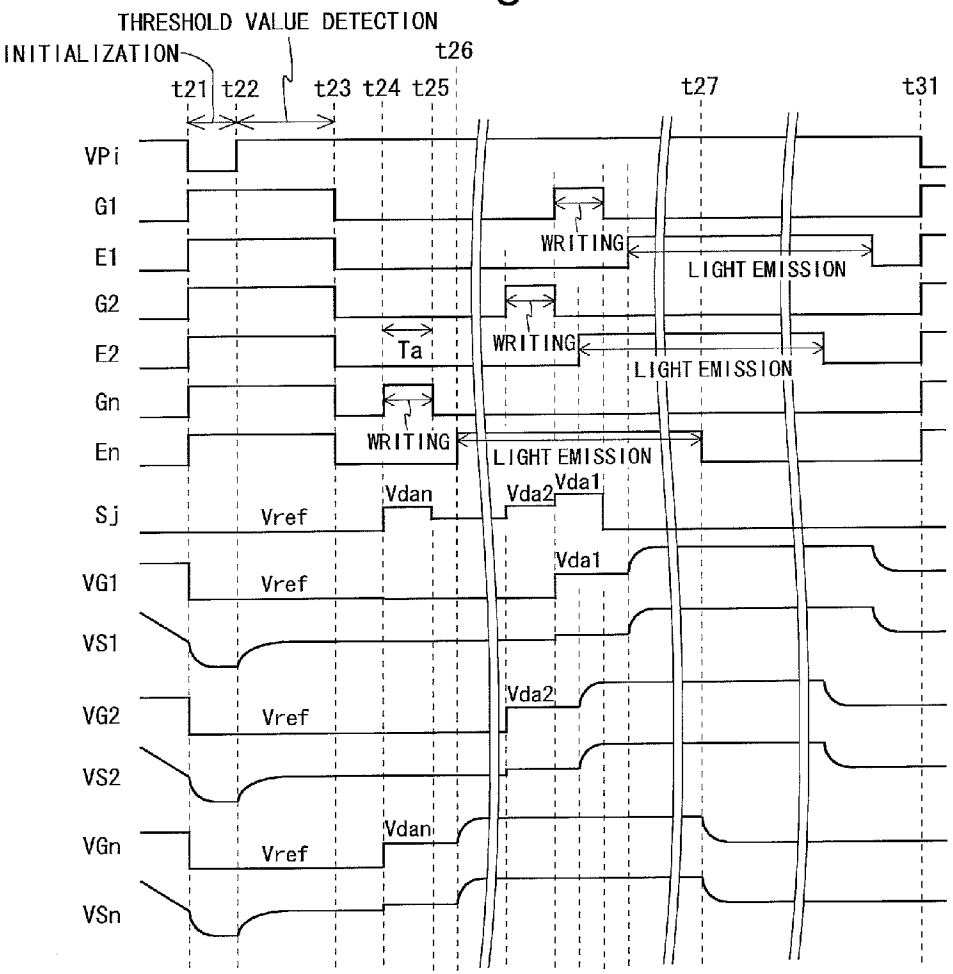
FIG. 6 is a timing chart (second frame) showing a method of driving the pixel circuits in the first embodiment.

FIGS. 5 and 6 are timing charts showing a method of driving the pixel circuits 10 in the present embodiment. FIG. 5 is a timing chart of a preceding frame (referred to as the "first frame") of two consecutive frame periods. FIG. 6 is a timing chart of a subsequent frame (referred to as the "second frame") of the two frame periods. In FIGS. 5 and 6, VGi indicates the gate potential of TFTs 12 included in pixel circuits 10 of an ith row, and VSi indicates the source potential of the TFTs 12 (the anode potential of organic EL elements 16). Each pixel circuit 10 performs one initialization, one threshold value detection (detection of a threshold value of a TFT 12), one writing, and one light emission during one frame period, and turns its light off during periods other than the light emission period. Note that, although the organic EL element 16 is the one that emits light (and turns its light off), since the pixel circuit 10 includes the organic EL element 16, the phrases "the pixel circuit 10 emits light" and "the pixel circuit 10 turns its light off" are used in the following. Note also that a frame period is a unit period for displaying a single image, and may include a black insertion period and the like, and can be set to various lengths.

With reference to FIG. 5, the operation of each of pixel circuits 10 of the first row for the first frame will be described. Prior to time t11, the potentials of the scanning signal line G1 and the control line E1 are at a low level, and the potential of the power line VP1 is at a high level. At time t11, the potentials of the scanning signal line G1 and the control line E1 change to a high level (become active). By this, the TFT 11 and the TFT 13 are placed in an on state. In addition, at time t11, the potential of the power line VP1 changes to a low level. The low-level potential of the power line VPi is hereinafter referred to as VP_L. For the potential VP_L, a sufficiently low potential, specifically, a potential lower than the gate potential of the TFT 12 obtained immediately before time t11, is used. In addition, at time t11, a reference potential Vref is applied to the data line Sj. Thus, as described above, since the TFT 11 is placed in an on state, the reference potential Vref is provided to the gate of the TFT 12. The reference potential Vref is set to a relatively high level, and thus the TFT 12 is placed in an on state. As described above, since the TFT 13 is also in the on state, a source potential VS1 of the TFT 12 becomes substantially equal to VP_L.

At time t12, the potential of the power line VP1 changes to a high level. At this time, the reference potential Vref is being applied to the data line Sj. The reference potential Vref is determined such that the TFT 12 is placed in an on state immediately after the above-described time t11, and the applied voltage to an organic EL element 16 does not exceed a light emission threshold voltage after time t12. Hence, after time t12, the TFT 12 is maintained in the on state, but a current does not flow through the organic EL element 16. Therefore, a current flows into the source terminal of the TFT 12 from the power line VP1 through the TFT 13 and the TFT 12, and thus the source potential VS1 of the TFT 12 rises. The source potential VS1 of the TFT 12 rises until a gate-source voltage Vgs becomes equal to a threshold voltage Vth, and reaches (Vref−Vth).

At time t13, the potential of the scanning signal line G1 changes to a low level. By this, the TFT 11 is placed in an off state. In addition, since the potential of the control line E1 also changes to a low level, the TFT 13 is placed in an off state after time t13. Hence, the source potential VS1 of the TFT 12 is maintained substantially at (Vref-Vth).

At time t14, the potential of the scanning signal line G1 changes to a high level, and the potential of the data line Sj reaches a level according to display data. The potential of the data line Sj obtained at this time is hereinafter referred to as a data potential Vdai. After time t14, the TFT 11 is placed in an on state and a gate potential VG1 of the TFT 12 changes from Vref to Vda1. The gate-source voltage Vgs of the TFT 12 after time t14 is given by the following equation (1):

$$Vgs = \{C_{OLED} / (C_{OLED} + C_{st})\} \times (Vdal - Vref) + Vth. \quad (1)$$

In the equation (1), $C_{OLED}$ is the capacitance value of the organic EL element 16, and $C_{st}$ is the capacitance value of a capacitor 15.

The capacitance value of the organic EL element 16 is sufficiently large, and thus $C_{OLED} >> C_{st}$, holds true. Hence, the equation (1) can be transformed (approximated) into the following equation (2):

$$Vgs = Vda1 - Vref + Vth \quad (2).$$

As such, when the gate potential VG1 of the TFT 12 is changed from Vref to Vda1, the source potential VS1 of the TFT 12 does not change almost at all, and the gate-source voltage Vgs of the TFT 12 reaches substantially (Vda1−Vref+Vth).

At time t15, the potential of the scanning signal line G1 changes to a low level. After time t15, the TFT 11 is placed in an off state. Hence, even when the potential of the data line Sj changes, the gate-source voltage Vgs of the TFT 12 is maintained substantially at (Vda1−Vref+Vth).

At time t16, the potential of the control line E1 changes to a high level. After time t16, the TFT 13 is placed in an on state, and the drain terminal of the TFT 12 is connected to the power line VP1 through the TFT 13. At this time, since the potential of the power line VP1 is at the high level, a current flows into the source terminal of the TFT 12 from the power line VP1 through the TFT 13 and the TFT 12, and thus the source potential VS1 of the TFT 12 rises. At this point in time, the gate terminal of the TFT 12 is in a floating state. Therefore, when the source potential VS1 of the TFT 12 rises, the gate potential VG1 of the TFT 12 also rises. At this time, the gate-source voltage Vgs of the TFT 12 is maintained substantially constant.

The high-level potential applied to the power line VP1 is determined such that the TFT 12 operates in a saturation region during a light emission period (time t16 to t17). Hence, a current I flowing through the TFT 12 during the light emission period is given by the following equation (3), ignoring the channel-length modulation effect:

$$I = \tfrac{1}{2} \cdot W/L \cdot \mu \cdot Cox(Vgs - Vth)^2 \quad (3).$$

In the equation (3), W is the gate width, L is the gate length, μ is the carrier mobility, and Cox is the capacitance of a gate oxide film.

Then, the following equation (4) is derived from the equation (2) and the equation (3):

$$I = \tfrac{1}{2} \cdot W/L \cdot \mu Cox(Vda1 - Vref)^2 \quad (4).$$

The current I shown in the equation (4) changes according to the data potential Vda1, but does not depend on the threshold voltage Vth of the TFT 12. Therefore, even when the threshold voltage Vth varies or when the threshold voltage Vth changes over time, a current according to the data potential Vda1 can be allowed to flow through the organic EL element 16, and thus the organic EL element 16 can be allowed to emit light at a desired luminance.

At time t17, the potential of the control line E1 changes to a low level. After time t17, the TFT 13 is placed in an off state. Hence, a current does not flow through the organic EL element 16, and thus the pixel circuit 10 turns its light off.

As described above, the pixel circuits 10 of the first row perform initialization during the period from time t11 to time t12, perform threshold value detection during the period from time t12 to time t13, perform writing during the period from time t14 to time t15, emit light during the period from time t16 to time t17, and turn their light off during periods other than the period from time t16 to time t17.

Pixel circuits 10 of the second row perform initialization during the period from time t11 to time t12 and perform threshold value detection during the period from time t12 to time t13, as with the pixel circuits 10 of the first row, and then perform writing and light emission, delayed by a predetermined time period Ta from the pixel circuits 10 of the first row. In general, pixel circuits 10 of an ith row perform initialization and threshold value detection during the same period as pixel circuits 10 of other rows, and perform writing and light emission, delayed by the time period Ta from pixel circuits 10 of an (i−1)th row. As such, in the first frame, the writing and light emission of the pixel circuits 10 on a row-by-row basis are performed in ascending order.

Next, the operation of the pixel circuits 10 for the second frame will be described. As is grasped from FIG. 6, also in the second frame, first, the pixel circuits 10 of all rows perform initialization and threshold value detection. Thereafter, writing and light emission are performed in reverse order from that for the first frame (in descending order). Specifically, the pixel circuits 10 of all rows perform initialization during the period from time t21 to time t22, and perform threshold value detection during the period from time t22 to time t23. Thereafter, the pixel circuits 10 of the nth row to the first row perform writing and light emission in descending order, delayed by a predetermined time period Ta. In general, pixel circuits 10 of an ith row perform initialization and threshold value detection during the same period as pixel circuits 10 of other rows, and perform writing and light emission, delayed by the time period Ta from pixel circuits 10 of an (i+1)th row. As such, in the second frame, the writing and light emission of the pixel circuits 10 on a row-by-row basis are performed in descending order.

As described above, in the present embodiment, in all frames, first, the pixel circuits 10 of all rows perform initialization and threshold value detection. Thereafter, the writing and light emission of the pixel circuits 10 are performed on a row-by-row basis such that the scanning order is reversed every frame.

Figure 1:
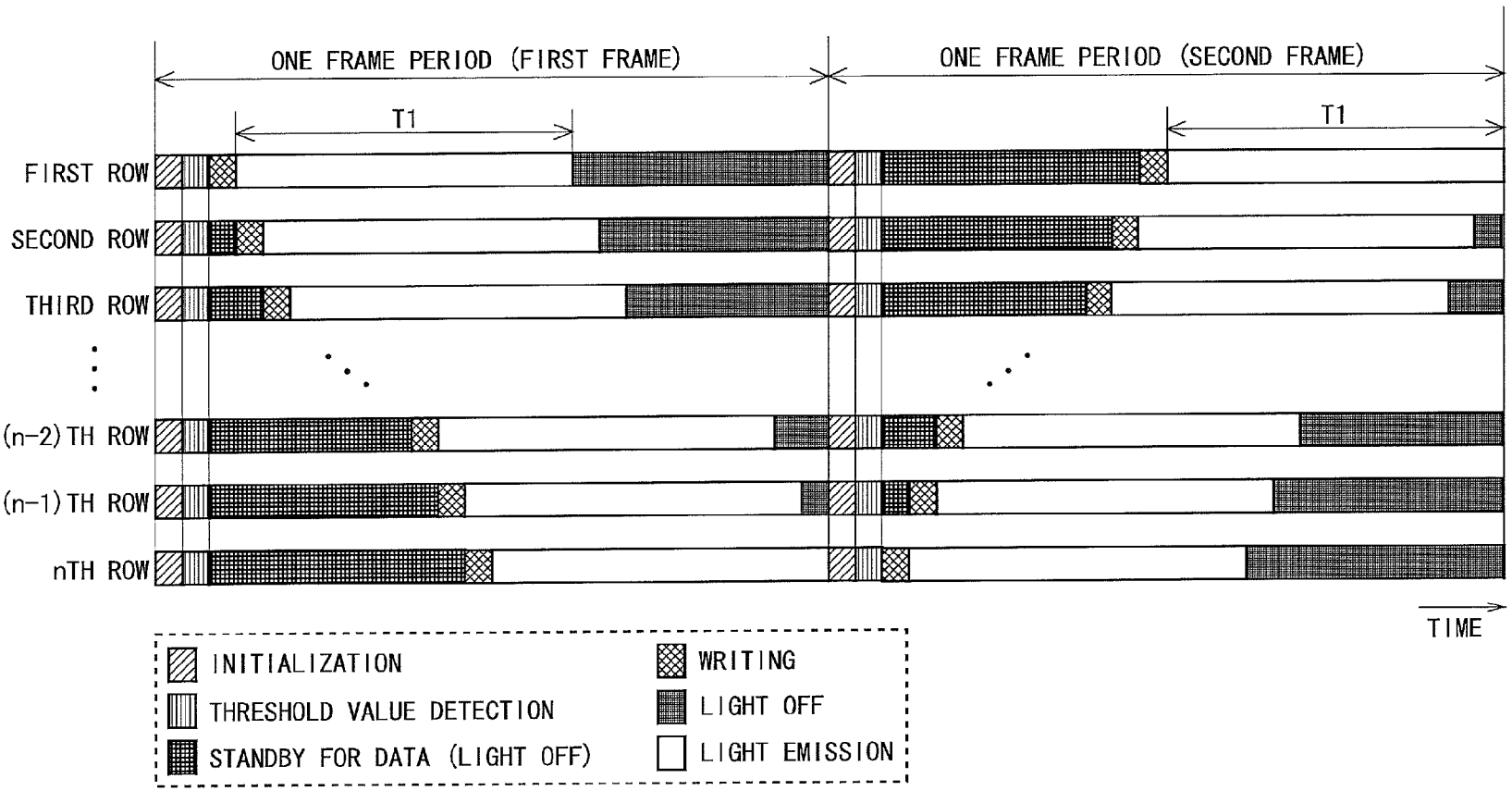
FIG. 1 is a diagram showing the operation of pixel circuits of each row in a display device according to a first embodiment of the present invention.

FIG. 1 is a diagram showing the operation of pixel circuits 10 of each row in the present embodiment. In both of the first and second frames, the power control circuit **4*a* applies a low-level potential (initialization potential) to the common power line 111 for a predetermined time period at the start of one frame period. Hence, the pixel circuits 10 of all rows perform initialization at the start of one frame period. Then, in both of the first and second frames, the pixel circuits 10 of all rows perform threshold value detection immediately after the initialization. Subsequently, in the first frame, pixel circuits 10 of the first row are selected, and the pixel circuits 10 of the first row perform writing. Then, pixel circuits 10 of the second row are selected, and the pixel circuits 10 of the second row perform writing. Thereafter, likewise, pixel circuits 10 of the third to the nth row are selected in turn on a row-by-row basis, and the selected pixel circuits 10 perform writing. On the other hand, in the second frame, after the threshold value detection, pixel circuits 10 of the nth row are selected, and the pixel circuits 10 of the nth row perform writing. Then, pixel circuits 10 of the (n−1)th row are selected, and the pixel circuits 10 of the (n−1)th row perform writing. Thereafter, likewise, pixel circuits 10 of the (n−2)th to the first row are selected on a row-by-row basis in reverse order from that for the first frame, and the selected pixel circuits 10** perform writing.

The pixel circuits 10 of each row turn their light off during the period from threshold value detection until immediately before writing. Meanwhile, the pixel circuits 10 of each row need to emit light for the same amount of time. In addition, in the first frame, light emission of pixel circuits 10 of the nth row needs to be completed before the end of the frame period. Furthermore, in the second frame, light emission of pixel circuits 10 of the first row needs to be completed before the end of the frame period. Hence, the pixel circuits 10 of each row emit light for a fixed time period T1 after writing, and turn their light off during other periods.

In a common display device, writing to the pixel circuits 10 (of all rows) is performed over one frame period. On the other hand, in the present embodiment, as shown in FIG. 1, (in order to secure a light emission period of about a ½ frame), writing to the pixel circuits 10 is performed over about a ½ frame period. Hence, the scanning speed of the pixel circuits 10 is about twice the normal one. It should be noted that, although in this example the length T1 of the light emission period of the pixel circuits 10 is about a ½ frame period, the length of the light emission period may be made shorter than a ½ frame period, with the scanning speed of the pixel circuits 10 remaining about twice the normal one. Alternatively, the scanning speed of the pixel circuits 10 may be made faster than about twice the normal one, and the length of the light emission period may be made longer than a ½ frame period.

1.4 Effects

A display device according to the present embodiment includes a plurality of pixel circuits 10 arranged in a matrix form; a plurality of scanning signal lines Gi and a plurality of control lines Ei provided for the respective rows of the pixel circuits 10; a plurality of data lines Sj provided for the respective columns of the pixel circuits 10; a plurality of power lines VPi provided to supply a power supply potential to the pixel circuits 10; a common power line(s) 9 (111) connected to the n power lines VPi; a gate driver circuit 2 that drives the scanning signal lines Gi and the control lines Ei; a source driver circuit 3 that drives the data lines Sj; and a power control circuit 4 (4*a*) that drives the power lines VPi. Each pixel circuit 10 includes an organic EL element 16 (electro-optic element); a TFT 12 (driving transistor) provided on a path of a current flowing through the organic EL element 16; a TFT 11 (write control transistor) provided between the gate terminal of the TFT 12 and a corresponding data line Sj; a TFT 13 (light emission control transistor) provided between the drain terminal of the TFT 12 and a corresponding power line VPi; and a capacitor 15 provided between the source and gate terminals of the TFT 12. According to the present embodiment, in a configuration as described above, in all frames, after the pixel circuits 10 of all rows perform initialization and threshold value detection, the pixel circuits 10 are selected in turn on a row-by-row basis. Each of the selected pixel circuits 10 performs writing to the capacitor 15 provided between the source and gate terminals of the TFT 12 functioning as a driving transistor, and light emission based on the writing. Meanwhile, as described above, upon threshold value detection, the applied voltage to the organic EL element 16 does not exceed a light emission threshold voltage, and during the period after the threshold value detection and before writing starts, the gate-source voltage Vgs of the TFT 12 is maintained in a state of being equal to a threshold voltage Vth. Hence, as shown in FIGS. 5 and 6, during the period from the time of completion of threshold value detection until the time of start of writing (hereinafter, referred to as the "standby period"), ideally, the source potential VSi of the TFT 12, i.e., the anode potential of the organic EL element 16, is maintained. However, the movement of charge caused by leakage current in the TFT 12 and the organic EL element 16 is not always zero. Therefore, the anode potential of the organic EL element 16 when writing is performed may vary from row to row, depending on the length of the standby period. For example, a case may be considered in which due to leakage current in the organic EL element 16, the anode potential is relatively high in a row with a short standby period, and the anode potential is relatively low in a row with a long standby period. When such a case occurs, even if writing based on a data signal with a fixed luminance value is performed, the luminance actually appearing on a screen may vary depending on the scanning order (the selection order of the pixel circuits on a row-by-row basis). As a result, luminance non-uniformity occurs. In this regard, according to the present embodiment, the scanning order is reversed every frame. Hence, with two frame periods being one unit period, the length of the total standby period during one unit period becomes equal for all rows. By this, the amount of movement of charge caused by leakage current in the TFT 12 and the organic EL element 16 becomes equal for all rows. As a result, the amount of change in the anode potential of the organic EL element 16 when performing writing becomes substantially equal for all of the pixel circuits 10, suppressing the occurrence of luminance non-uniformity.

In addition, since initialization of the pixel circuits 10 of all rows is collectively performed at the start of each frame period, the initialization period can be set to be an appropriate period, typically, a period longer than the selection period. Hence, even when the current capability of output buffers included in the power control circuit 4 is low, sufficient drive can be performed. Furthermore, the power control circuit 4 drives a single common power line 9 electrically connected to all of the power lines VPi. Therefore, compared to a configuration in which the power lines VPi are driven individually, the number of output buffers to be provided in the power control circuit 4 is significantly reduced, enabling to reduce the circuit size of the power control circuit 4. In addition, since supply of an initialization potential is performed using the power lines VPi, signal lines for supplying an initialization potential, or the like, become unnecessary, and thus the number of elements in the pixel circuits 10 can be reduced. Furthermore, since the number of drives of a power supply can be set to 1 per frame, power consumption can be reduced over the case of, for example, performing such a number of drives that corresponds to the number of rows of the pixel circuits 10. In addition, since the number of common power lines 9 is 1 (or a small number), the area of a wiring line region for power supply can be reduced.

Moreover, since the pixel circuits 10 of all rows perform threshold value detection collectively, the threshold value detection period can be set to be an appropriate period, typically, a period longer than the selection period. Hence, threshold value detection can be reliably performed, enabling to improve the accuracy of threshold value compensation. In addition, compared to a configuration in which threshold value detection is performed during a selection period, a pixel data write period can be sufficiently secured. Hence, the present invention can be easily applied even in a configuration in which the write period is short, for example, a three-dimensional image display device (3D television), i.e., a configuration in which drive is performed at high speed.

In addition, as described above, the pixel circuits 10 of each row emit light for a fixed time period T1 after writing and turn their light off during other periods. By this, the lengths of the light emission periods of the pixel circuits 10 of all rows become equal, suppressing variations in luminance. Furthermore, since the pixel circuits 10 turn their light off during periods other than the light emission period, moving image performance can be improved as in the case of performing black insertion.

Furthermore, all transistors included in each pixel circuit 10 are of an N-channel type. By thus configuring the transistors included in the pixel circuit 10 by the same conductive type of transistors, the cost of the display device can be reduced.

It should be noted that, although the configuration is such that the scanning order is reversed every frame in the present embodiment, the present invention is not limited thereto, and the configuration may be such that the scanning order is revered every plurality of frames, e.g., every two frames or every three frames. The same applies to variants which will be described later and other embodiments.

1.5 Variants

1.5.1 First Variant

Figure 7:
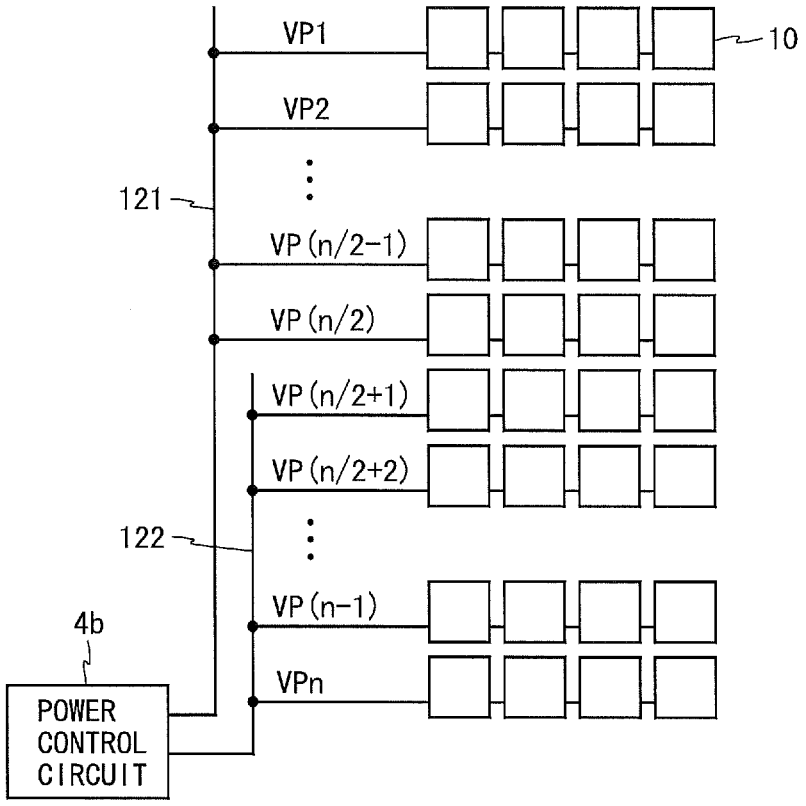
FIG. 7 is a diagram showing a connection form of power lines in a first variant of the first embodiment.

FIG. 7 is a diagram showing a connection form of power lines VPi in a first variant of the first embodiment. In the present variant, a display device 100 is provided with two common power lines 121 and 122 to connect a power control circuit 4*b* to the power lines VPi. The respective one ends of the common power lines 121 and 122 are connected to two output terminals of the power control circuit 4*b*, respectively. Power lines VP1 to VP (n/2) are connected to the common power line 121, and power lines VP(n/2+1) to VPn are connected to the common power line 122. That is, in the present variant, one row group is formed by the first to the (n/2)th row, and another row group is formed by the (n/2+1)th to the nth row.

Figure 8:
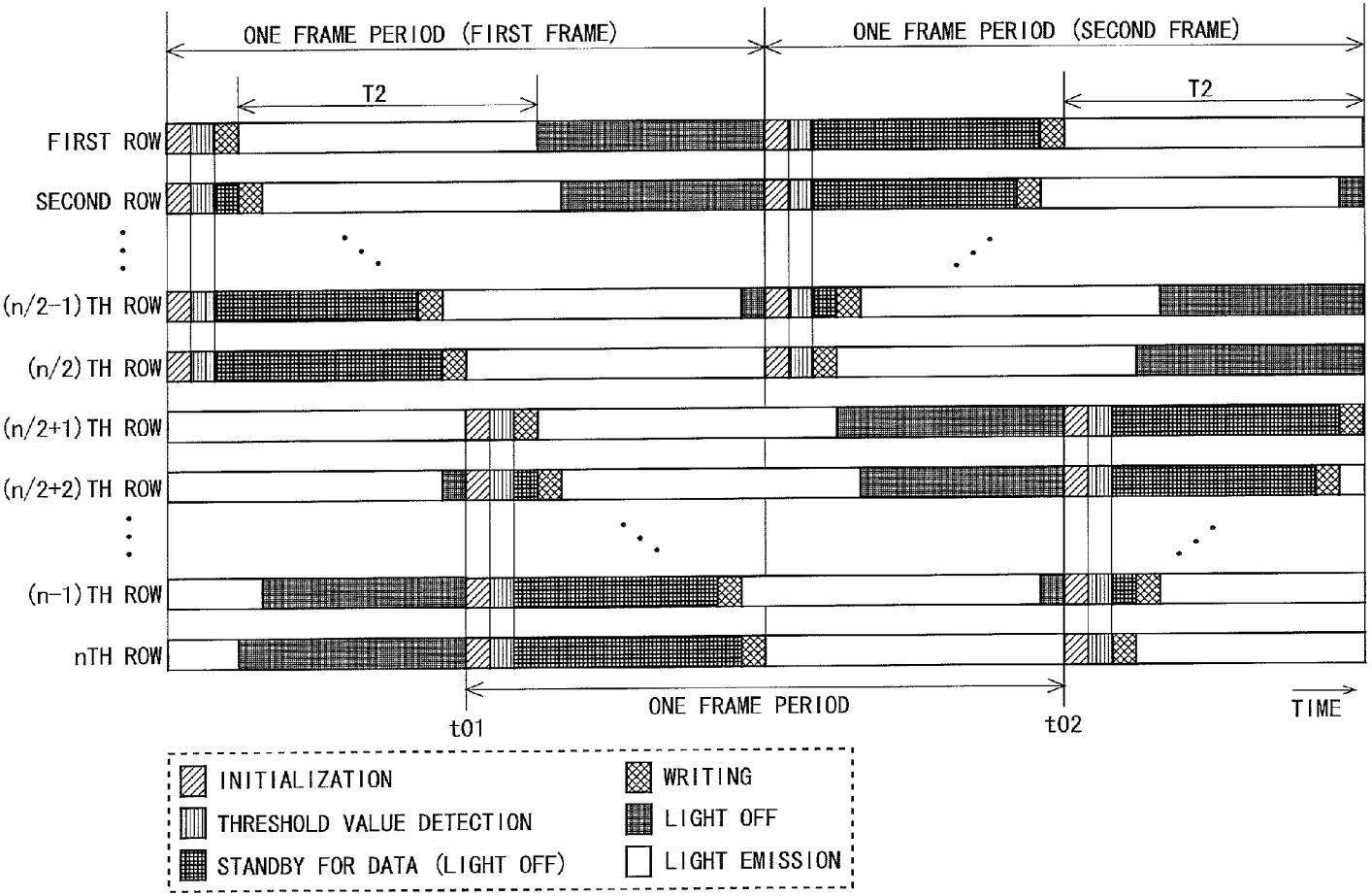
FIG. 8 is a diagram showing the operation of pixel circuits of each row in the first variant of the first embodiment.

FIG. 8 is a diagram showing the operation of pixel circuits 10 of each row in the present variant. In both of the first and second frames, the power control circuit 4*b* applies a low-level potential to the common power line 121 for a predetermined time period at the start of one frame period, and applies a low-level potential to the common power line 122 for a predetermined time period after a lapse of a ½ frame period. Hence, pixel circuits 10 of the first to the (n/2)th row perform initialization at the start of one frame period, and pixel circuits 10 of the (n/2+1)th to the nth row perform initialization, delayed by a ½ frame period.

In both of the first and second frames, after the first initialization, all of the pixel circuits 10 of the first to the (n/2)th row are simultaneously selected, and after the second initialization, all of the pixel circuits 10 of the (n/2+1)th to the nth row are simultaneously selected. The selected pixel circuits 10 perform threshold value detection.

In the first frame, after the first threshold value detection, the pixel circuits 10 of the first to the (n/2)th row are selected in ascending order, and after the second threshold value detection, the pixel circuits 10 of the (n/2+1)th to the nth row are selected in ascending order. The selected pixel circuits 10 perform writing. The pixel circuits 10 of each row emit light for a fixed time period T2 after writing, and turn their light off during other periods. In the second frame, after the first threshold value detection, the pixel circuits 10 of the first to the (n/2)th row are selected in descending order, and after the second threshold value detection, the pixel circuits 10 of the (n/2+1)th to the nth row are selected in descending order. The selected pixel circuits 10 perform writing. The pixel circuits 10 of each row emit light for a fixed time period T2 after writing, and turn their light off during other periods. In the example shown in FIG. 8, the scanning speed of the pixel circuits 10 is the same as the normal one, and the length T2 of the light emission period of the pixel circuits 10 is about a ½ frame period.

By focusing on the row group formed by the (n/2+1) to the nth row, it can also be considered that "a given frame period starts at time t01 and the frame period ends at time t02". Second and subsequent variants can also be considered in the same manner.

According to the present variant, the number of output buffers to be provided in the power control circuit 4 (4*b*) is smaller than the number of the power lines VPi. Thus, compared to a configuration in which the power lines VPi are driven individually, the circuit size of the power control circuit 4 (4*b*) can be reduced. In addition, by applying an initialization potential to the common power line 121 and the common power line 122 at different timings, initialization of the pixel circuits 10 can be performed at suitable timing in accordance with the selection period of the pixel circuits 10.

1.5.2 Second Variant

Figure 9:
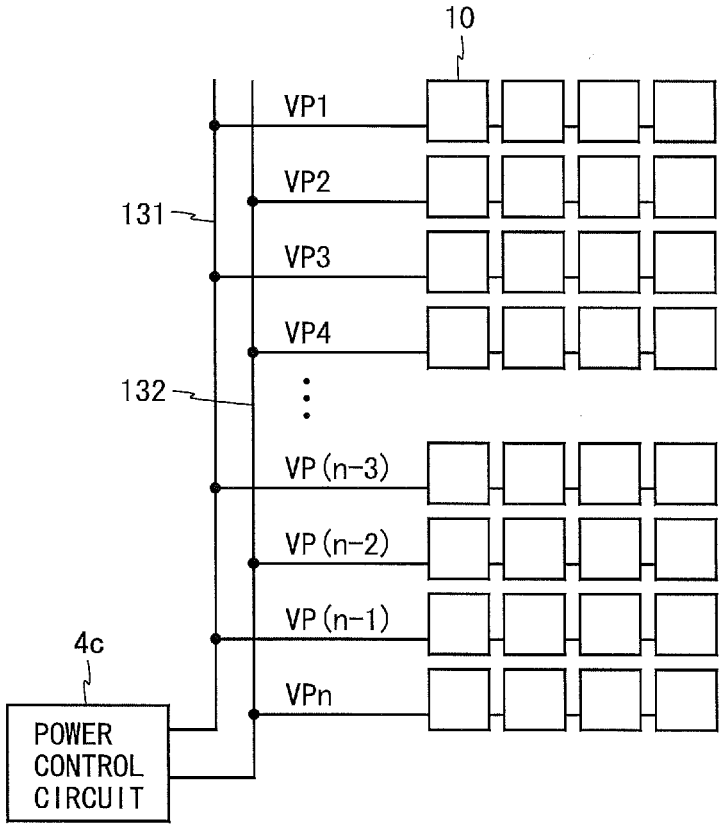
FIG. 9 is a diagram showing a connection form of power lines in a second variant of the first embodiment.

FIG. 9 is a diagram showing a connection form of power lines VPi in a second variant of the first embodiment. In the present variant, a display device 100 is provided with two common power lines 131 and 132 to connect a power control circuit 4*c* to the power lines VPi. The respective one ends of the common power lines 131 and 132 are connected to two output terminals of the power control circuit 4*c*, respectively. Power lines VP1, VP3, . . . , VP (n−1) of the odd rows are connected to the common power line 131, and power lines VP2, VP4, . . . , VPn of the even rows are connected to the common power line 132 (here, n is an even number). That is, in the present variant, one row group is formed by the odd rows, and another row group is formed by the even rows.

Figure 10:
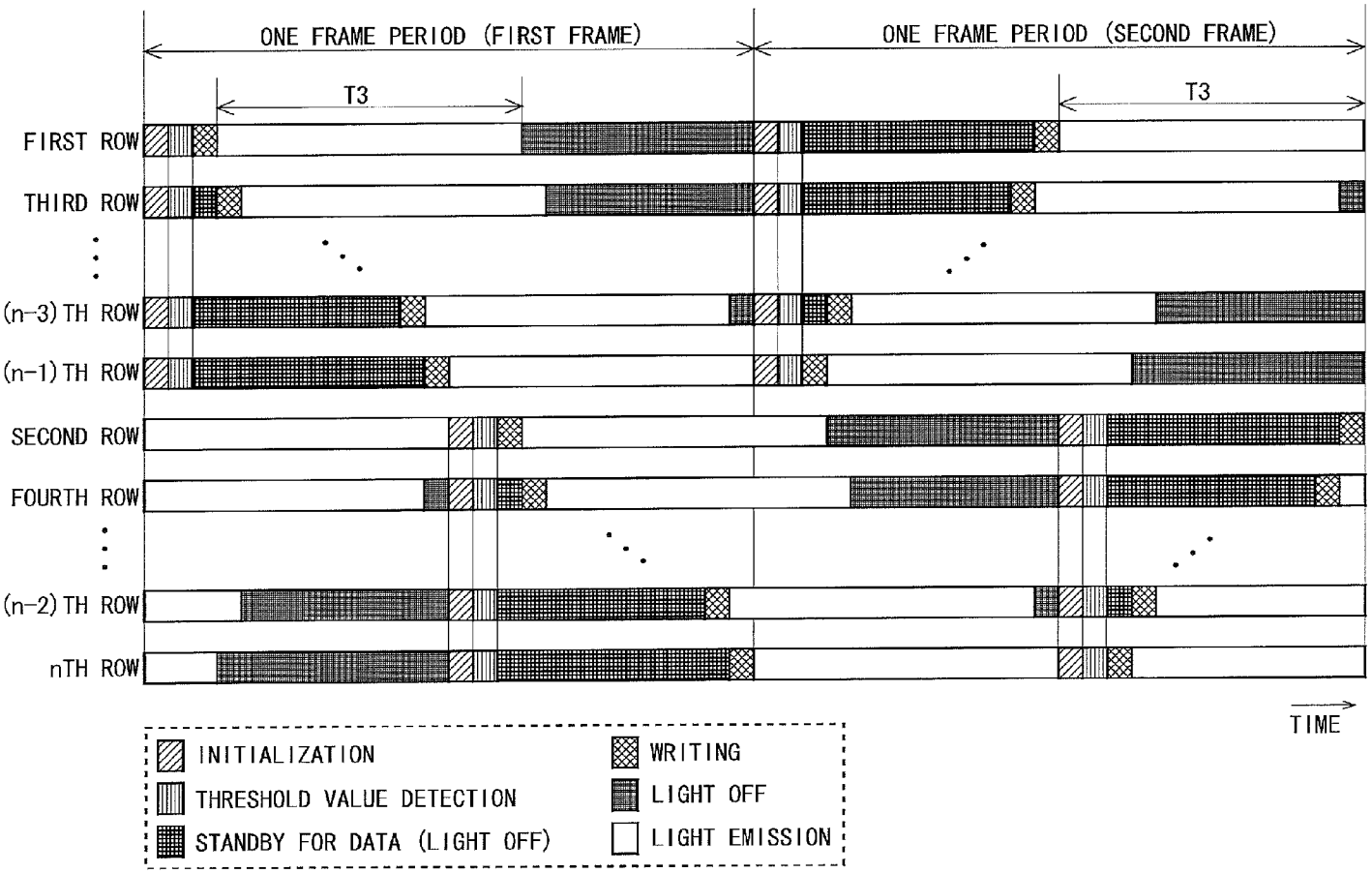
FIG. 10 is a diagram showing the operation of pixel circuits of each row in the second variant of the first embodiment.

FIG. 10 is a diagram showing the operation of pixel circuits 10 of each row in the present variant. In both of the first and second frames, the power control circuit 4*c* applies a low-level potential to the common power line 131 for a predetermined time period at the start of one frame period, and applies a low-level potential to the common power line 132 for a predetermined time period after a lapse of a ½ frame period. Hence, pixel circuits 10 of the odd rows perform initialization at the start of one frame period, and pixel circuits 10 of the even rows perform initialization, delayed by a ½ frame period.

In both of the first and second frames, after the first initialization, all of the pixel circuits 10 of the odd rows are simultaneously selected, and after the second initialization, all of the pixel circuits 10 of the even rows are simultaneously selected. The selected pixel circuits 10 perform threshold value detection.

In the first frame, after the first threshold value detection, the pixel circuits 10 of the odd rows are selected in ascending order, and after the second threshold value detection, the pixel circuits 10 of the even rows are selected in ascending order. The selected pixel circuits 10 perform writing. The pixel circuits 10 of each row emit light for a fixed time period T3 after writing, and turn their light off during other periods. In the second frame, after the first threshold value detection, the pixel circuits 10 of the odd rows are selected in descending order, and after the second threshold value detection, the pixel circuits 10 of the even rows are selected in descending order. The selected pixel circuits 10 perform writing. The pixel circuits 10 of each row emit light for a fixed time period T3 after writing, and turn their light off during other periods. In the example shown in FIG. 10, the scanning speed of the pixel circuits 10 is the same as the normal one, and the length T3 of the light emission period of the pixel circuits 10 is about a ½ frame period.

According to the first variant described above, writing can be performed to the pixel circuits 10 according to the order on a display screen. However, when there is a big difference in the amount of the flowing current between the common power line 121 and the common power line 122 (see FIG. 7), such as when there is a big difference in luminance between the upper half of the screen and the lower half of the screen, a difference in luminance may occur at the center of the screen. In this regard, according to the second variant, the amounts of current flowing through the common power lines 131 and 132 are substantially the same in many cases, and thus, a difference in luminance occurring at the center of the screen can be prevented.

1.5.3 Third Variant

Figure 11:
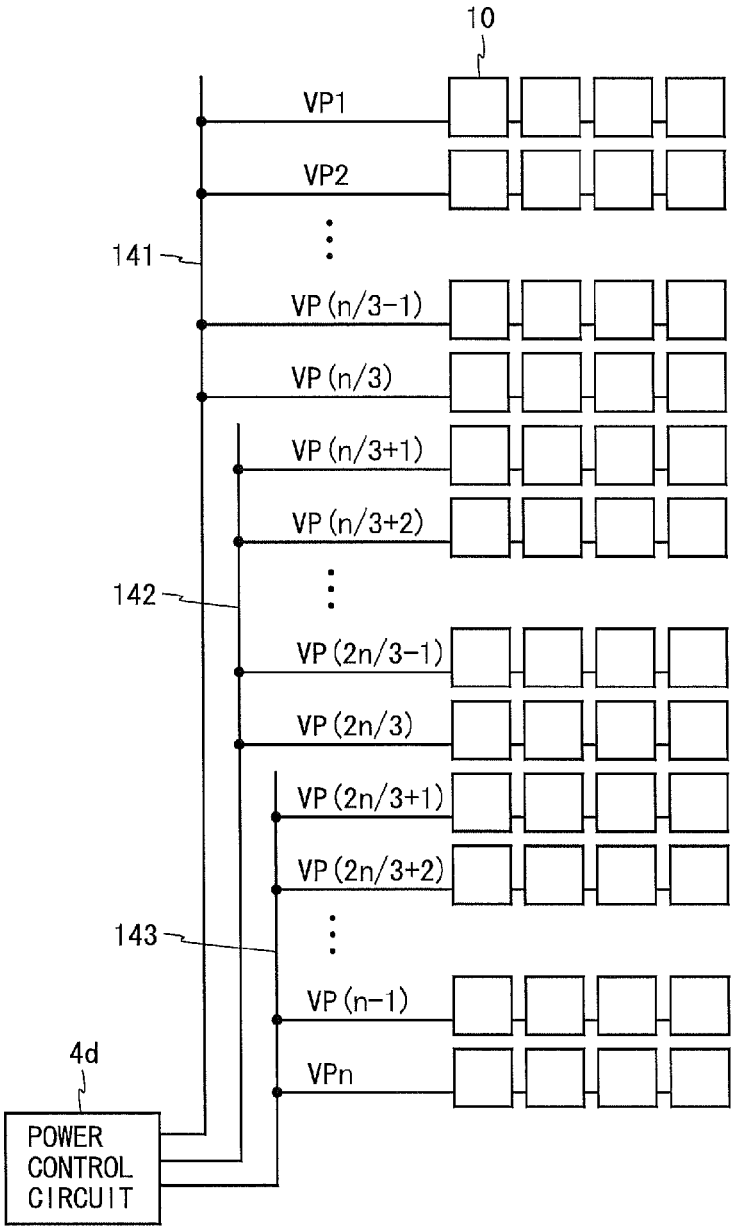
FIG. 11 is a diagram showing a connection form of power lines in a third variant of the first embodiment.

FIG. 11 is a diagram showing a connection form of power lines VPi in a third variant of the first embodiment. In the present variant, a display device 100 is provided with three common power lines 141 to 143 to connect a power control circuit 4*d* to the power lines VPi. The respective one ends of the common power lines 141 to 143 are connected to three output terminals of the power control circuit 4*d*, respectively. Power lines VP1 to VP(n/3) are connected to the common power line 141, power lines VP(n/3+1) to VP(2n/3) are connected to the common power line 142, and power lines VP(2n/3+1) to VPn are connected to the common power line 143. That is, in the present variant, a first row group is formed by the first to the (n/3)th row, a second row group is formed by the (n/3+1)th to the (2n/3)th row, and a third row group is formed by the (2n/3+1)th to the nth row.

Figure 12:
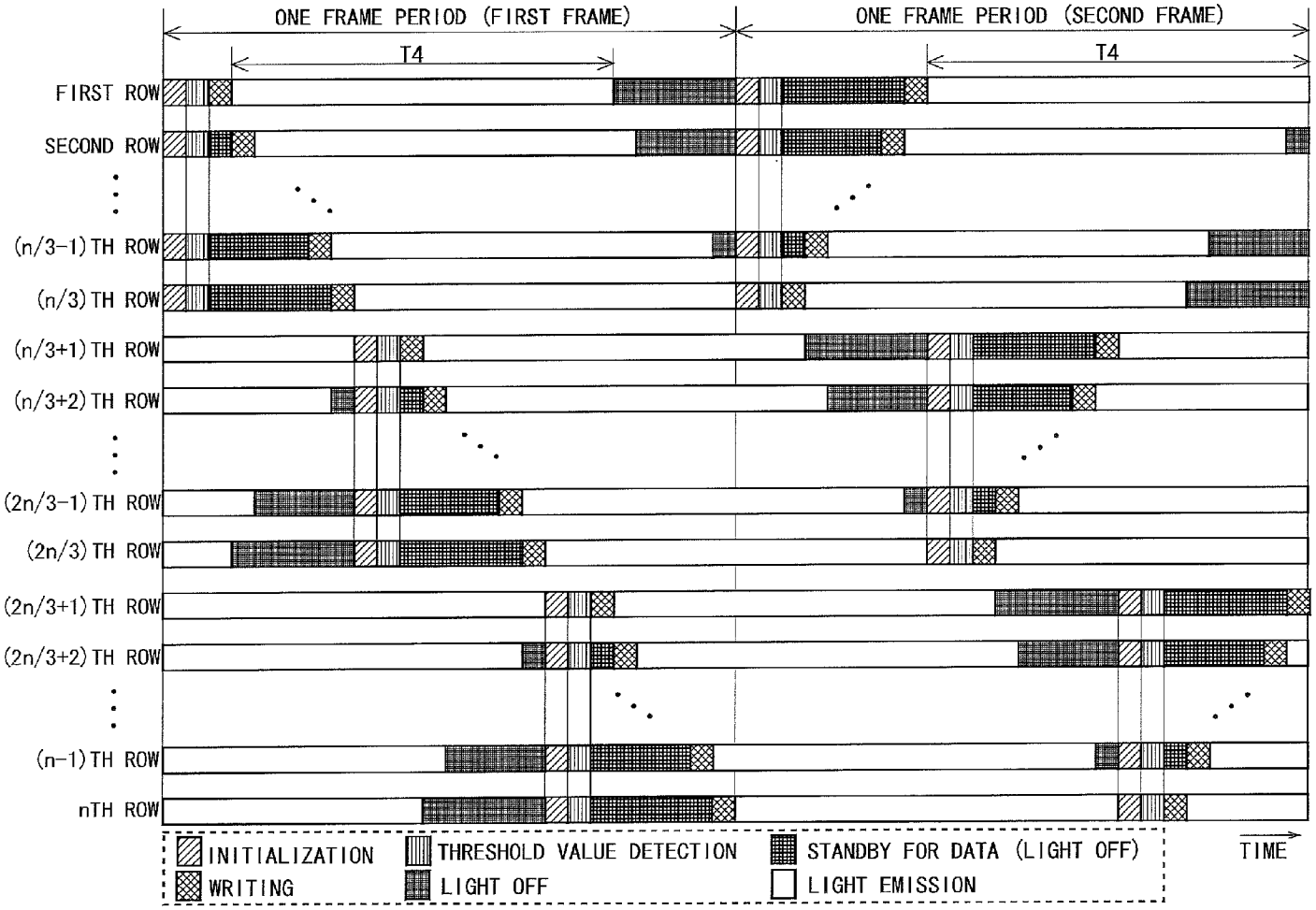
FIG. 12 is a diagram showing the operation of pixel circuits of each row in the third variant of the first embodiment.

FIG. 12 is a diagram showing the operation of pixel circuits 10 of each row in the present variant. In both of the first and second frames, the power control circuit 4*d* applies a low-level potential to the common power line 141 for a predetermined time period at the start of one frame period, applies a low-level potential to the common power line 142 for a predetermined time period after a lapse of a ⅓ frame period, and applies a low-level potential to the common power line 143 for a predetermined time period further after a lapse of a ⅓ frame period. Hence, pixel circuits 10 of the first to the (n/3)th row perform initialization at the start of one frame period, pixel circuits 10 of the (n/3+1)th to the (2n/3)th row perform initialization, delayed by a ⅓ frame period, and pixel circuits 10 of the (2n/3+1)th to the nth row perform initialization, further delayed by a ⅓ frame period.

In both of the first and second frames, after the first initialization, all of the pixel circuits 10 of the first to the (n/3)th row are simultaneously selected, and after the second initialization, all of the pixel circuits 10 of the (n/3+1)th to the (2n/3)th row are simultaneously selected, and after the third initialization, all of the pixel circuits 10 of the (2n/3+1)th to the nth row are simultaneously selected. The selected pixel circuits 10 perform threshold value detection.

In the first frame, after the first threshold value detection, the pixel circuits 10 of the first to the (n/3)th row are selected in ascending order, and after the second threshold value detection, the pixel circuits 10 of the (n/3+1)th to the (2n/3)th row are selected in ascending order, and after the third threshold value detection, the pixel circuits 10 of the (2n/3+1)th to the nth row are selected in ascending order. The selected pixel circuits 10 perform writing. The pixel circuits 10 of each row emit light for a fixed time period T4 after writing, and turn their light off during other periods. In the second frame, after the first threshold value detection, the pixel circuits 10 of the first to the (n/3)th row are selected in descending order, and after the second threshold value detection, the pixel circuits 10 of the (n/3+1)th to the (2n/3)th row are selected in descending order, and after the third threshold value detection, the pixel circuits 10 of the (2n/3+1)th to the nth row are selected in descending order. The selected pixel circuits 10 perform writing. The pixel circuits 10 of each row emit light for a fixed time period T4 after writing, and turn their light off during other periods. In the example shown in FIG. 12, the scanning speed of the pixel circuits 10 is the same as the normal one, and the length T4 of the light emission period of the pixel circuits 10 is about a ⅔ frame period.

According to the present variant, during a period in which pixel circuits 10 of rows belonging to a given row group perform initialization and threshold value detection, pixel circuits 10 of rows belonging to other two row groups emit light. As such, the length of the light emission period of each pixel circuit 10 is about a ⅔ frame period. That is, compared to a configuration in which one or two common power lines are provided, the light emission period can be increased.

1.5.4 Other Variants

The number p of the common power lines 9 may be 4 or more. When p≥4, the connection form of the power lines VPi and the operation of pixel circuits 10 of each row are the same as those described above. In addition, when p≥3, (n/p) power lines disposed adjacent to each other may be connected to the same common power line, or (n/p) power lines selected skipping every (p−1) lines may be connected to the same common power line. For example, when p=3, the configuration may be such that the power lines VPi are selected skipping every two lines, and power lines VP1, VP4, . . . are connected to a first common power line, power lines VP2, VP5, . . . are connected to a second common power line, and power lines VP3, VP6, . . . are connected to a third common power line. In addition, when p=1, instead of providing n power lines VPi for the respective rows of the pixel circuits 10, m power lines may be provided for the respective columns of the pixel circuits 10.

As such, there is a trade-off relationship between the number p of the common power lines 9, the scanning speed of the pixel circuits 10, and the length of the light emission period of the pixel circuits 10. For example, by increasing the number p of the common power lines 9, the scanning speed of the pixel circuits 10 can be reduced or the light emission period of the pixel circuits 10 can be increased. However, in this case, the number of output buffers to be provided in the power control circuit 4 increases, and thus the circuit size of the power control circuit 4 increases. Therefore, these parameters may be determined taking into account the specifications, cost, and the like of the display device.

2. Second Embodiment

2.1 Configuration

Figure 13:
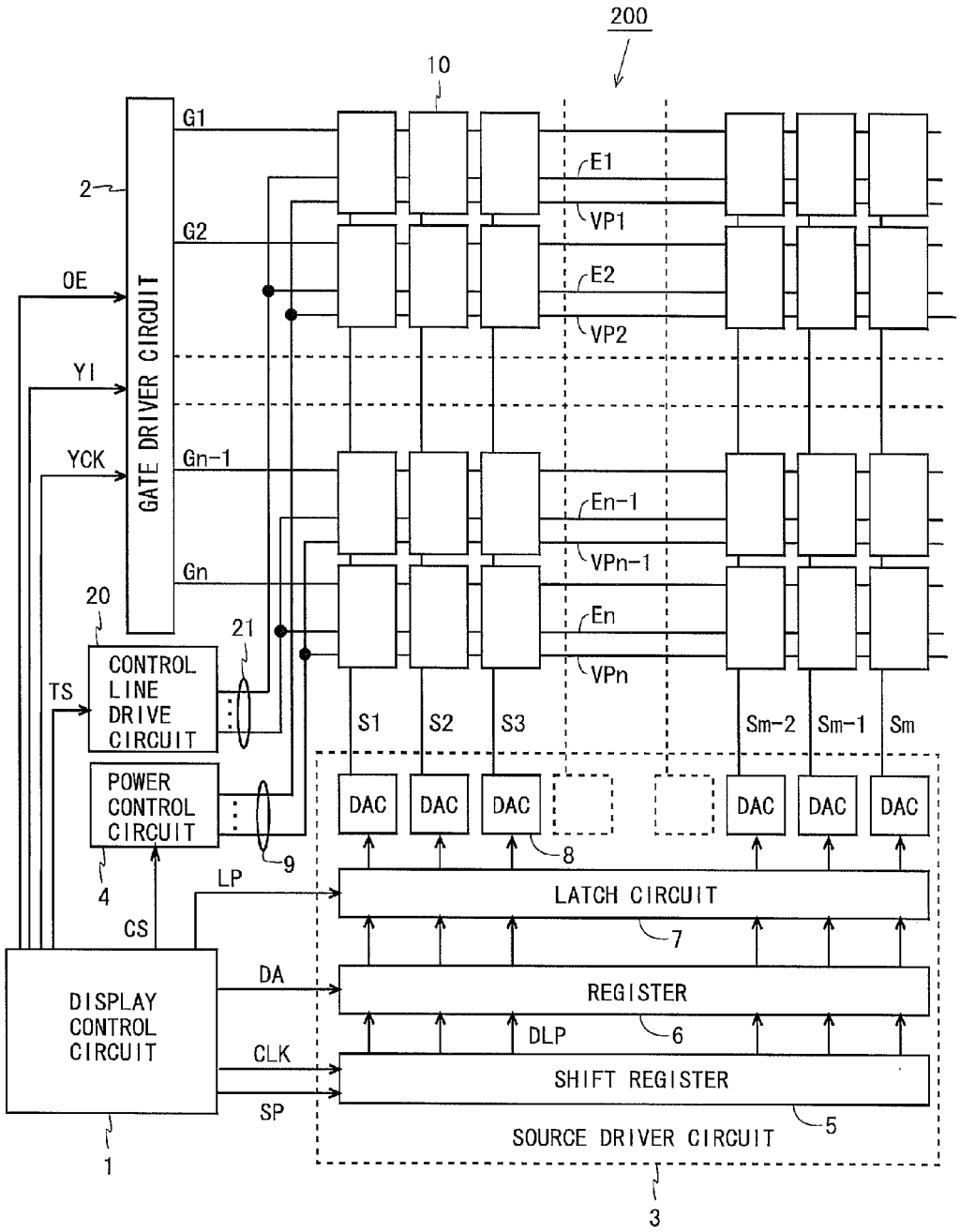
FIG. 13 is a block diagram showing an overall configuration of a display device according to a second embodiment of the present invention.

FIG. 13 is a block diagram showing an overall configuration of a display device according to a second embodiment of the present invention. A display device 200 shown in FIG. 13 includes, in addition to the components in the first embodiment (see FIG. 2), a control line drive circuit 20; and common control lines 21 for connecting the control line drive circuit 20 to control lines Ei. In the present embodiment, scanning signal lines Gi are connected to a gate driver circuit 2, and the control lines Ei are connected to the control line drive circuit 20 through the common control lines 21. By the gate driver circuit 2 and the control line drive circuit 20, a row drive circuit is implemented. The reason that the control line drive circuit 20 is provided separately from the gate driver circuit 2 is that, in the present embodiment, as will be described later, a plurality of control lines Ei are driven at once, and herein the gate driver circuit 2 is described as a circuit that outputs signals which become active in turn on a row-by-row basis. Therefore, for example, the gate driver circuit 2 and the control line drive circuit 20 may be configured by a single IC chip. Pixel circuits 10 have the configuration shown in FIG. 4, as in the first embodiment.

The control line drive circuit 20 has q output terminals for the respective q common control lines 21. The control line drive circuit 20 applies, based on a control signal TS, a high-level potential and a low-level potential to the common control lines 21 in a switching manner. When q=1, all of the control lines Ei are connected to a single common control line 21. When q≥2, the control lines Ei are divided into q groups, and control lines included in each group are connected to the same common control line 21. Power lines VPi and common power lines 9 are the same as those of the first embodiment. However, in the present embodiment, p=q is established, that is, the number of the common power lines 9 is equal to the number of the common control lines 21.

Figure 14:
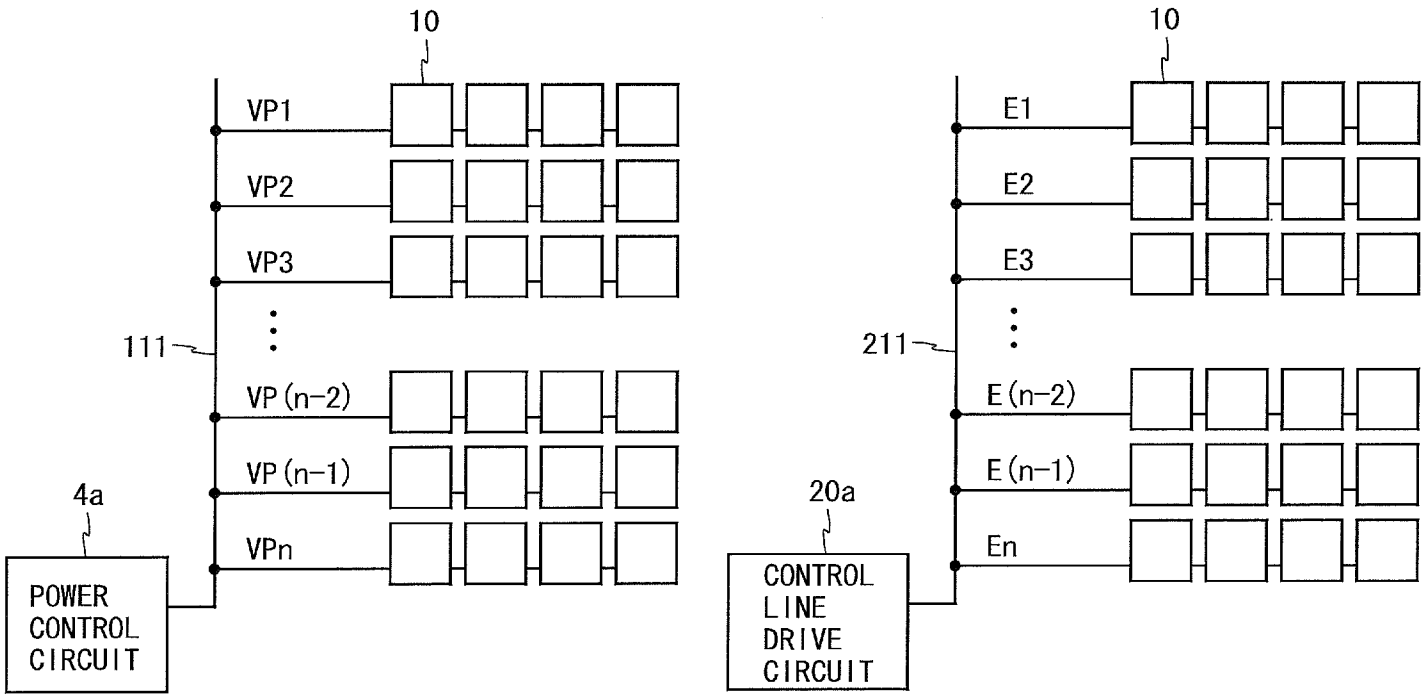
FIG. 14 is a diagram showing the connection forms of power lines and control lines in the second embodiment.

Here, first, the case of q=1 will be described as an example, and the case of q≥2 will be described later as variants (the case of q=2: a first variant and a second variant, and the case of q=3: a third variant). FIG. 14 is a diagram showing the connection forms of power lines VPi and control lines Ei in the present embodiment. As shown in FIG. 14, the display device 200 is provided with a single common power line 111 to connect the power control circuit 4*a* to the power lines VPi, and is provided with a single common control line 211 to connect the control line drive circuit 20*a* to the control lines Ei. One end of the common power line 111 is connected to one output terminal of the power control circuit 4*a*, and all of the power lines VPi are connected to the common power line 111. One end of the common control line 211 is connected to one output terminal of the control line drive circuit 20*a*, and all of the control lines Ei are connected to the common control line 211.

2.2 Drive Method

Figure 15:
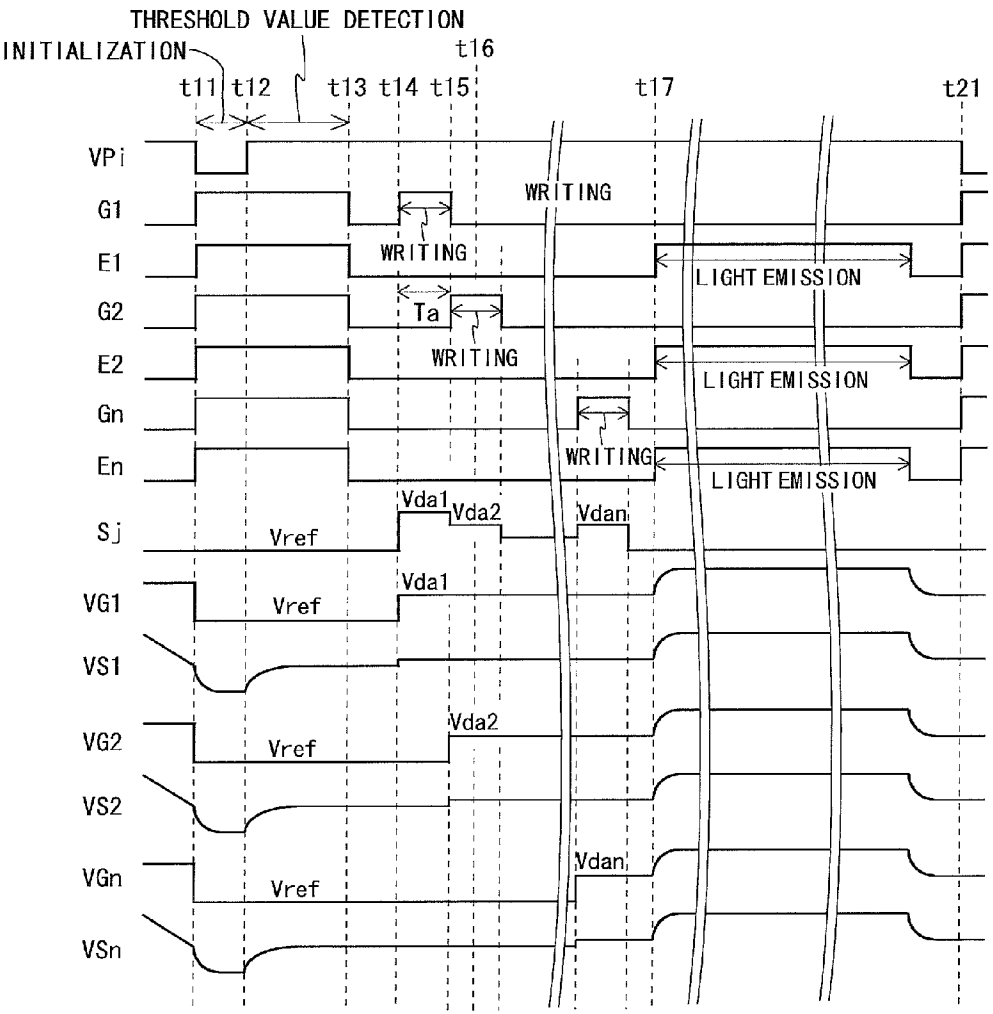
FIG. 15 is a timing chart (first frame) showing a method of driving pixel circuits in the second embodiment.
Figure 16:
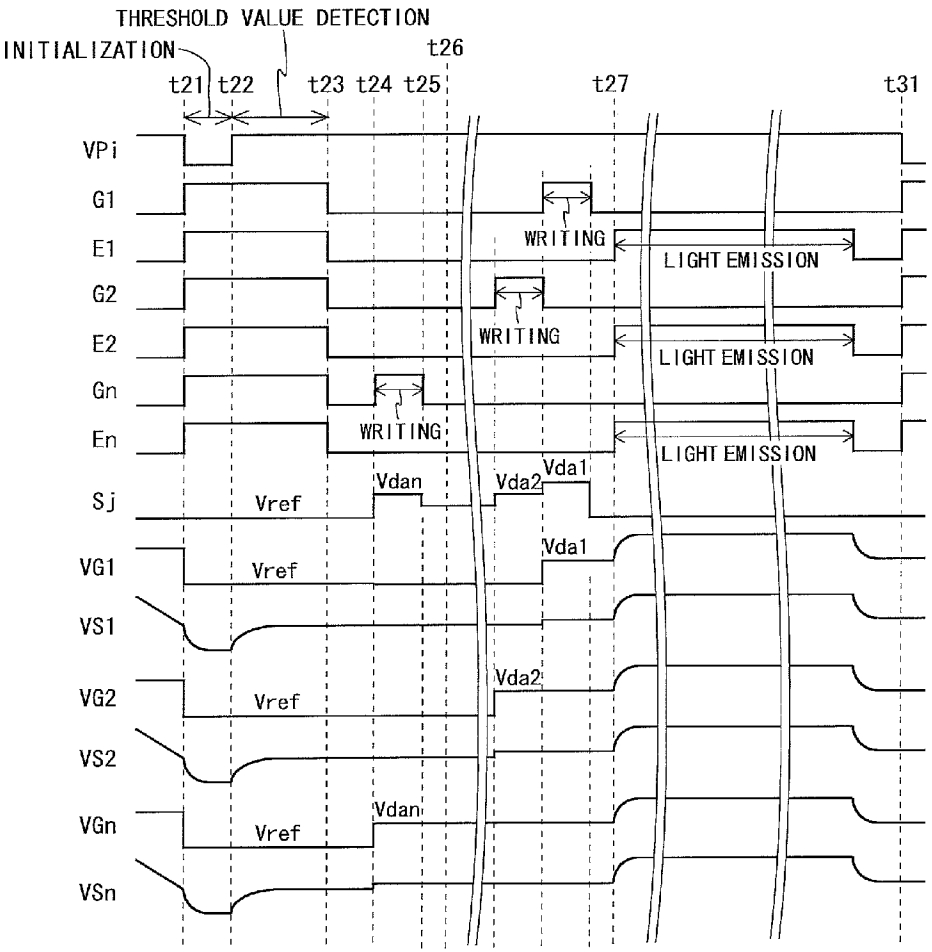
FIG. 16 is a timing chart (second frame) showing a method of driving the pixel circuits in the second embodiment.

FIGS. 15 and 16 are timing charts showing a method of driving the pixel circuits 10 in the present embodiment. FIG. 15 is a timing chart of the first frame of two consecutive frame periods, and FIG. 16 is a timing chart of the second frame of the two frame periods. Although the length of the period from the time of completion of writing until the time of start of light emission is equal for all rows in the first embodiment (see FIGS. 5 and 6), a row whose time of start of writing is relatively earlier in one frame period has a longer period from the time of completion of writing until the time of start of light emission in the present embodiment. By this, the pixel circuits 10 of all rows start light emission at the same timing, and complete the light emission at the same timing. Also in the present embodiment, writing of the pixel circuits 10 on a row-by-row basis is performed in ascending order in the first frame, and performed in descending order in the second frame.

Figure 17:
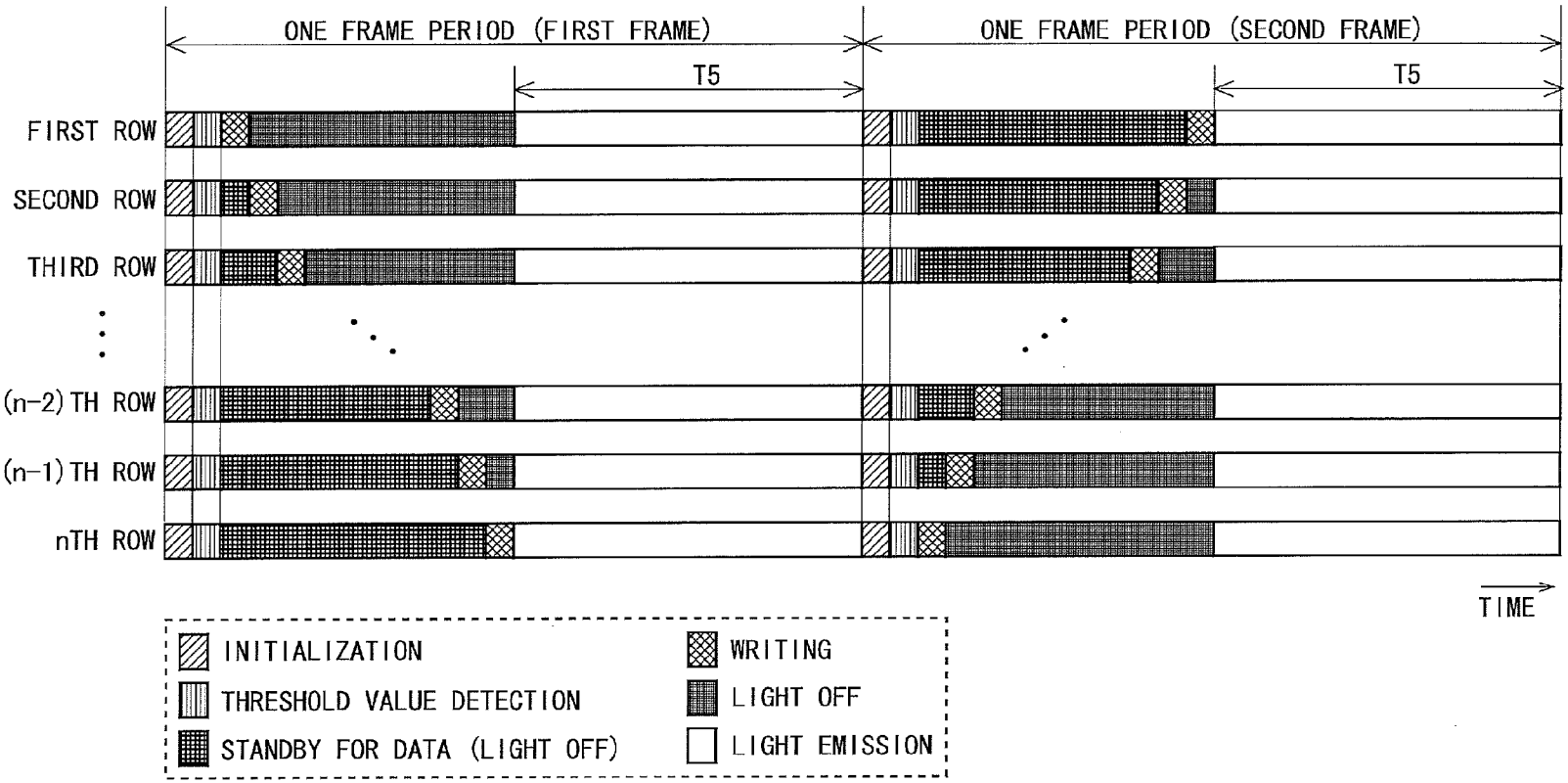
FIG. 17 is a diagram showing the operation of pixel circuits of each row in the second embodiment.

FIG. 17 is a diagram showing the operation of pixel circuits 10 of each row in the present embodiment. As in the first embodiment, each pixel circuit 10 performs one initialization, one threshold value detection (detection of a threshold value of a TFT 12), one writing, and one light emission during one frame period, and turns its light off during periods other than the light emission period. However, unlike the first embodiment, after pixel circuits 10 of each row turn their light off for a predetermined period of time which varies from row to row after the time of completion of writing, the pixel circuits 10 of all rows emit light simultaneously (collectively) for a fixed time period T5, and turn their light off simultaneously at the end of one frame period (in other words, immediately before initialization in the next frame).

2.3 Effects

According to the present embodiment, n control lines Ei are connected to the control line drive circuit 20 through a single common control line 21. Hence, compared to the first embodiment, the number of pins (terminals) to be provided on a circuit (a gate driver circuit 2 in the first embodiment and the control line drive circuit 20 in the present embodiment) for driving control lines can be reduced significantly. In addition, compared to the first embodiment, the size of the circuit for driving control lines can be reduced significantly.

Meanwhile, during a period in which the potential of a scanning signal line Gi and the potential of a control line Ei are at a low level in each row, even when the potential of a data line Sj changes, ideally, the gate-source voltage Vgs of the TFT 12 does not change. However, since there is a small leakage current in the TFT 12, the gate-source voltage Vgs actually decreases little by little. Due to this, when the length of the period from the time of completion of threshold value detection until the time of start of light emission varies from row to row as in the first embodiment, the magnitude of leakage current in the TFT 12 may vary from row to row, causing luminance non-uniformity. In this regard, according to the present embodiment, since the length of the period from the time of completion of threshold value detection until the time of start of light emission becomes equal for all rows, the magnitude of leakage current in the TFT 12 becomes equal for all of the pixel circuits 10. By this, the occurrence of luminance non-uniformity resulting from leakage current occurring in the TFTs 12 is suppressed.

2.4 Variants

2.4.1 First Variant

Figure 18:
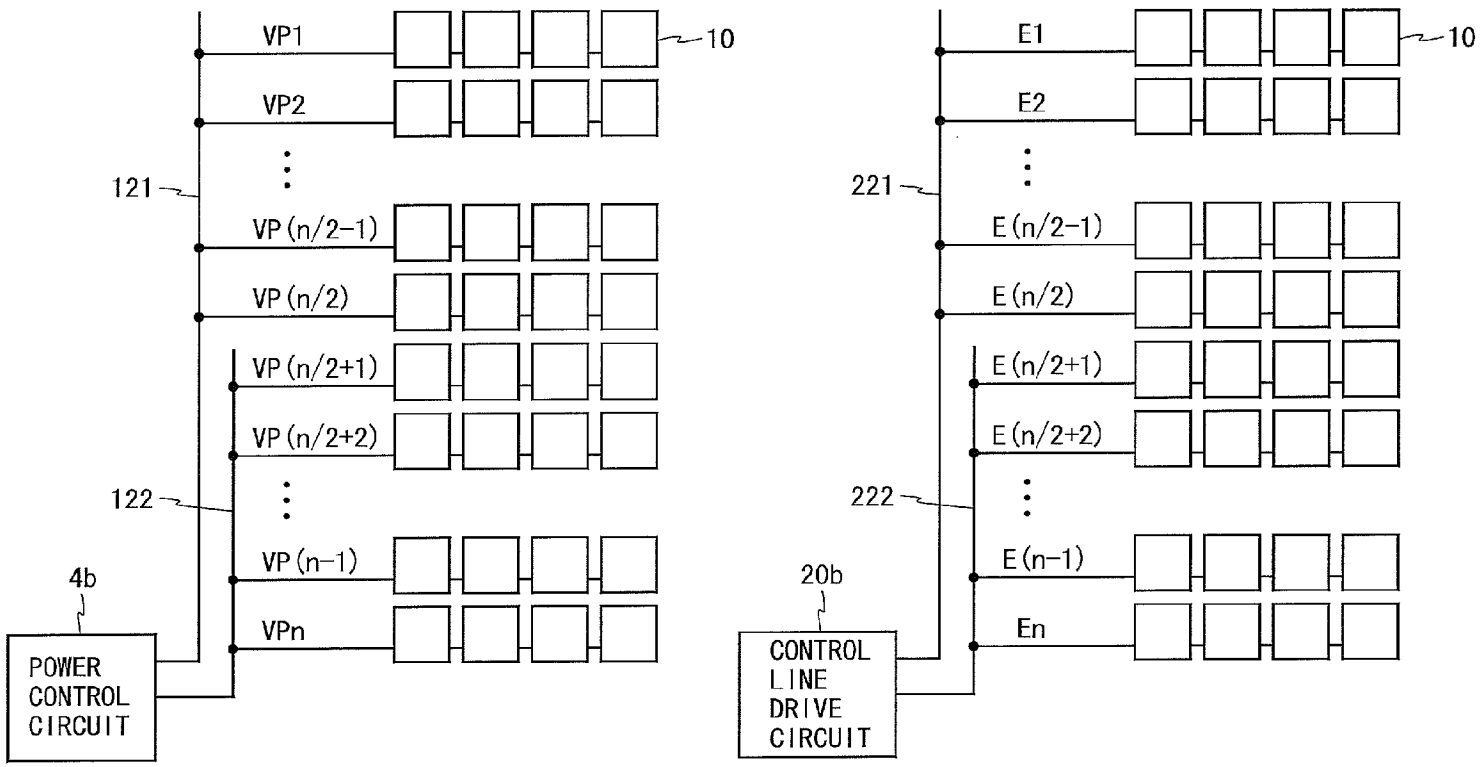
FIG. 18 is a diagram showing the connection forms of power lines and control lines in a first variant of the second embodiment.

FIG. 18 is a diagram showing the connection forms of power lines VPi and control lines Ei in a first variant of the second embodiment. In the present variant, a display device 200 is provided with two common power lines 121 and 122 to connect a power control circuit 4*b* to the power lines VPi, and is provided with two common control lines 221 and 222 to connect a control line drive circuit 20*b* to the control lines Ei. The respective one ends of the common power lines 121 and 122 are connected to two output terminals of the power control circuit 4*b*, respectively. Power lines VP1 to VP(n/2) are connected to the common power line 121, and power lines VP(n/2+1) to VPn are connected to the common power line 122. The respective one ends of the common control lines 221 and 222 are connected to two output terminals of the control line drive circuit 20*b*, respectively. Control lines E1 to E(n/2) are connected to the common control line 221, and control lines E(n/2+1) to En are connected to the common control line 222.

Figure 19:
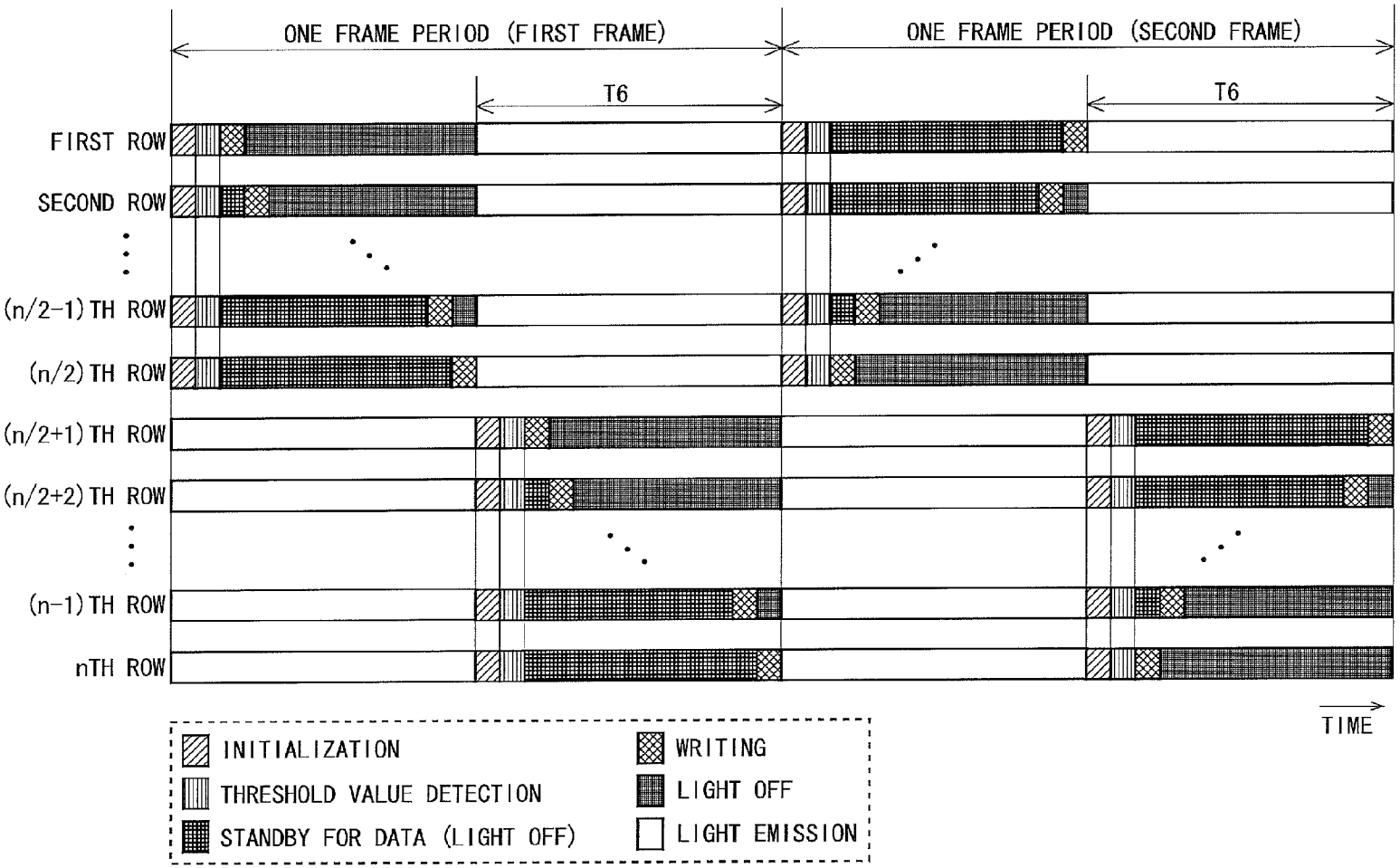
FIG. 19 is a diagram showing the operation of pixel circuits of each row in the first variant of the second embodiment.

FIG. 19 is a diagram showing the operation of pixel circuits 10 of each row in the present variant. In both of the first and second frames, pixel circuits 10 of the first to the (n/2)th row perform initialization and threshold value detection at the start of one frame period, and pixel circuits 10 of the (n/2+1)th to the nth row perform initialization and threshold value detection, delayed by a ½ frame period. In both of the pixel circuits 10 of the first to the (n/2)th row and the pixel circuits 10 of the (n/2+1)th to the nth row, writing of the pixel circuits 10 on a row-by-row basis is performed in ascending order in the first frame and performed in descending order in the second frame.

In the present variant, as shown in FIG. 19, in both of the first and second frames, all of the pixel circuits 10 of the first to the (n/2)th row start light emission at the same timing and complete the light emission at the same timing. In addition, all of the pixel circuits 10 of the (n/2+1)th to the nth row start light emission at the same timing and complete the light emission at the same timing. The length T6 of a light emission period is equal for the pixel circuits 10 of all rows. It should be noted that, in the example shown in FIG. 19, the scanning speed of the pixel circuits 10 is the same as the normal one, and the length T6 of the light emission period of the pixel circuits 10 is about a ½ frame period.

According to the present variant, compared to a configuration in which the power lines VPi and the control lines Ei are driven individually, the circuit sizes of the power control circuit 4 (4*b*) and the control line drive circuit 20 (20*b*) can be reduced. In addition, since the length of the period from the time of completion of threshold value detection until the time of start of light emission becomes equal for all rows, the occurrence of luminance non-uniformity resulting from leakage current occurring in the TFTs 12 in the pixel circuits 10 is suppressed.

2.4.2 Second Variant

Figure 20:
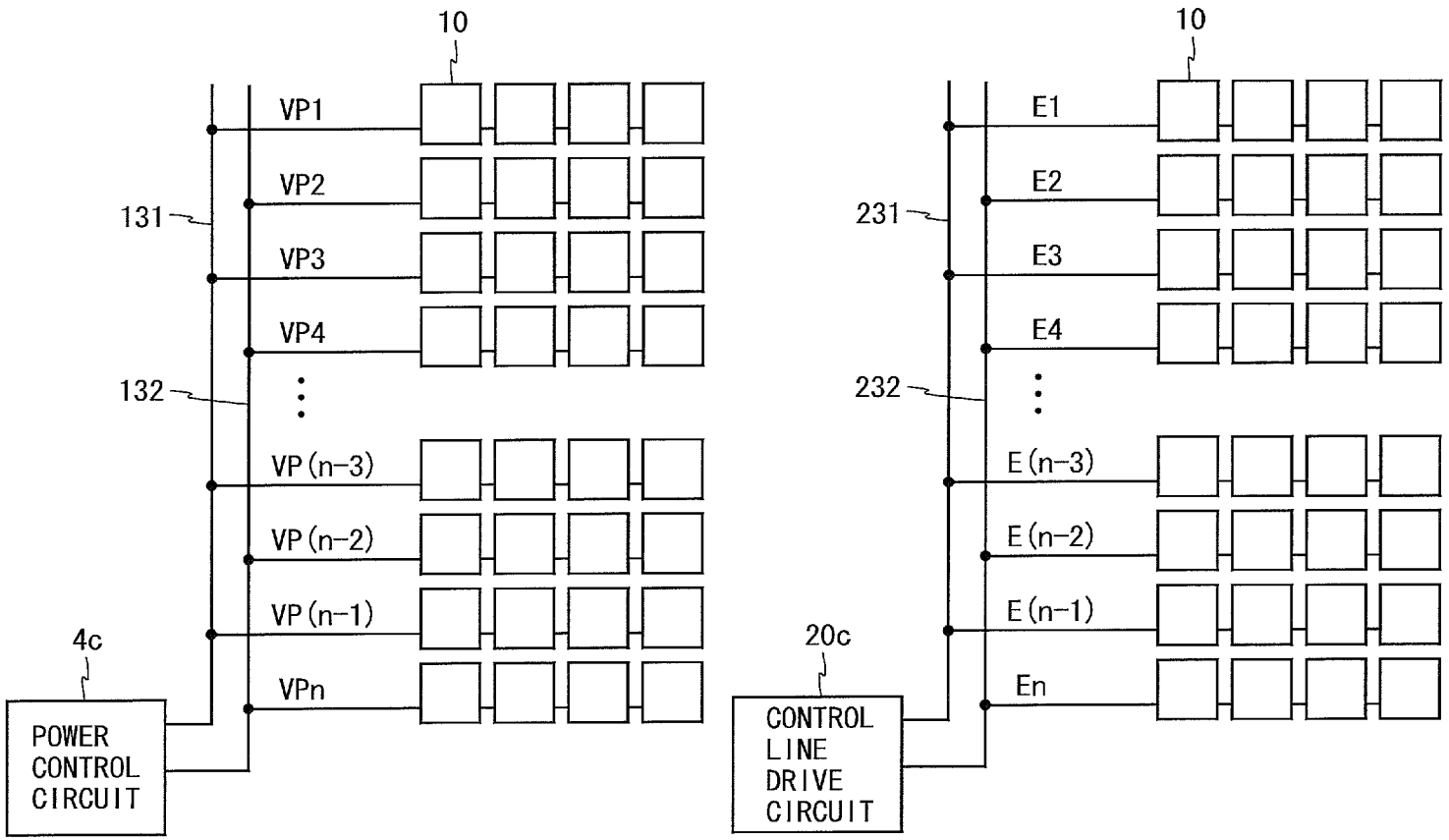
FIG. 20 is a diagram showing the connection forms of power lines and control lines in a second variant of the second embodiment.

FIG. 20 is a diagram showing the connection forms of power lines VPi and control lines Ei in a second variant of the second embodiment. In the present variant, a display device 200 is provided with two common power lines 131 and 132 to connect a power control circuit 4*c* to the power lines VPi, and is provided with two common control lines 231 and 232 to connect a control line drive circuit 20*c* to the control lines Ei. The respective one ends of the common power lines 131 and 132 are connected to two output terminals of the power control circuit 4*c*, respectively. Power lines VP1, VP3, . . . , VP(n−1) of the odd rows are connected to the common power line 131, and power lines VP2, VP4, . . . , VPn of the even rows are connected to the common power line 132 (here, n is an even number). The respective one ends of the common control lines 231 and 232 are connected to two output terminals of the control line drive circuit 20*c*, respectively. Control lines E1, E3, . . . , E(n−1) of the odd rows are connected to the common control line 231, and control lines E2, E4, . . . , En of the even rows are connected to the common control line 232.

Figure 21:
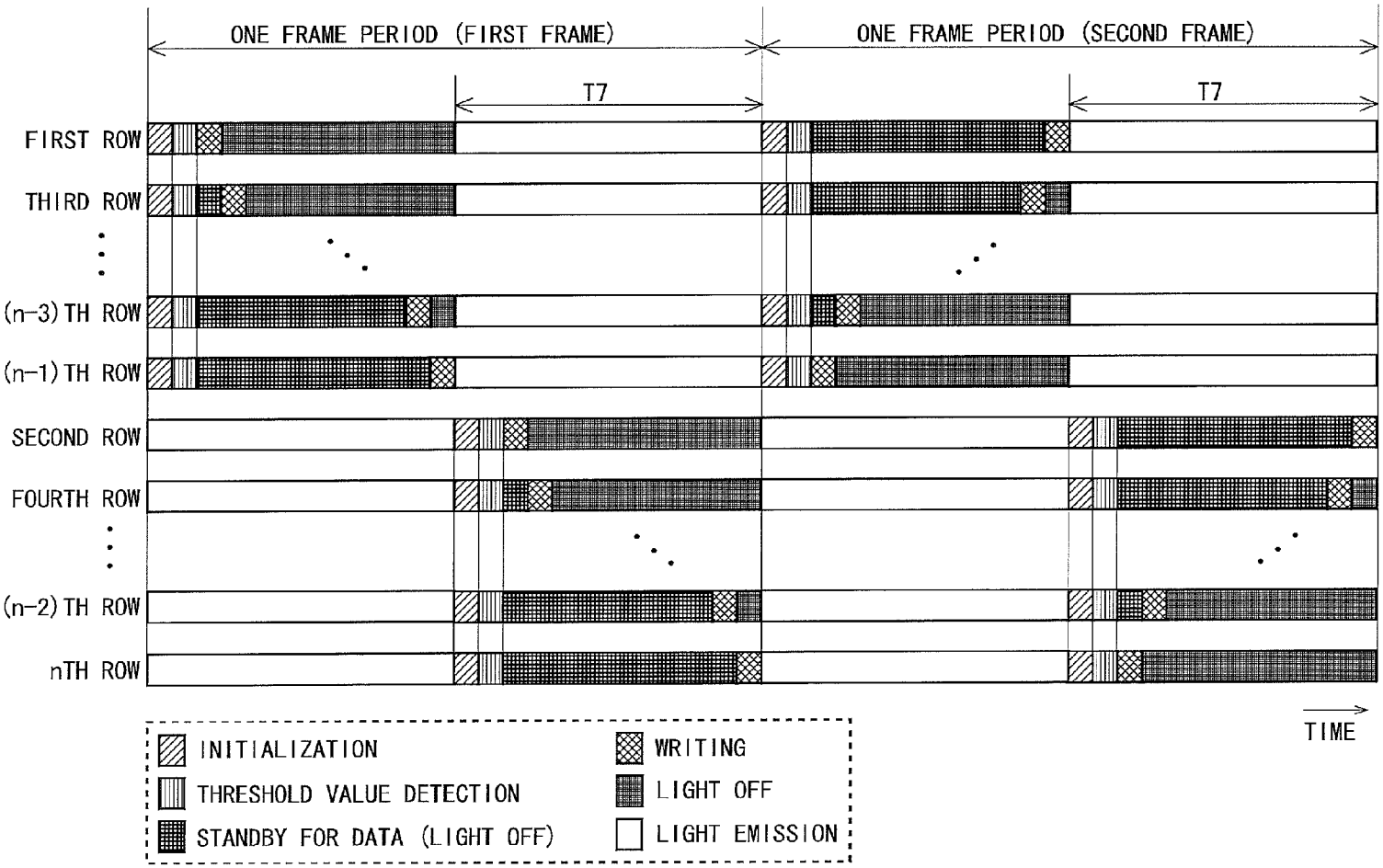
FIG. 21 is a diagram showing the operation of pixel circuits of each row in the second variant of the second embodiment.

FIG. 21 is a diagram showing the operation of pixel circuits 10 of each row in the present variant. In both of the first and second frames, pixel circuits 10 of the odd rows perform initialization and threshold value detection at the start of one frame period, and pixel circuits 10 of the even rows perform initialization and threshold value detection, delayed by a ½ frame period. In both of the pixel circuits 10 of the odd rows and the pixel circuits 10 of the even rows, writing of the pixel circuits 10 on a row-by-row basis is performed in ascending order in the first frame and performed in descending order in the second frame.

In the present variant, as shown in FIG. 21, in both of the first and second frames, all of the pixel circuits 10 of the odd rows start light emission at the same timing and complete the light emission at the same timing. In addition, all of the pixel circuits 10 of the even rows start light emission at the same timing and complete the light emission at the same timing. The length T7 of a light emission period is equal for the pixel circuits 10 of all rows. It should be noted that, in the example shown in FIG. 21, the scanning speed of the pixel circuits 10 is the same as the normal one, and the length T7 of the light emission period of the pixel circuits 10 is about a ½ frame period.

According to the present variant, the same effects as those obtained in the first variant are obtained. In addition, a difference in luminance occurring at the center of the screen can be prevented (see the second variant of the first embodiment).

2.4.3 Third Variant

Figure 22:
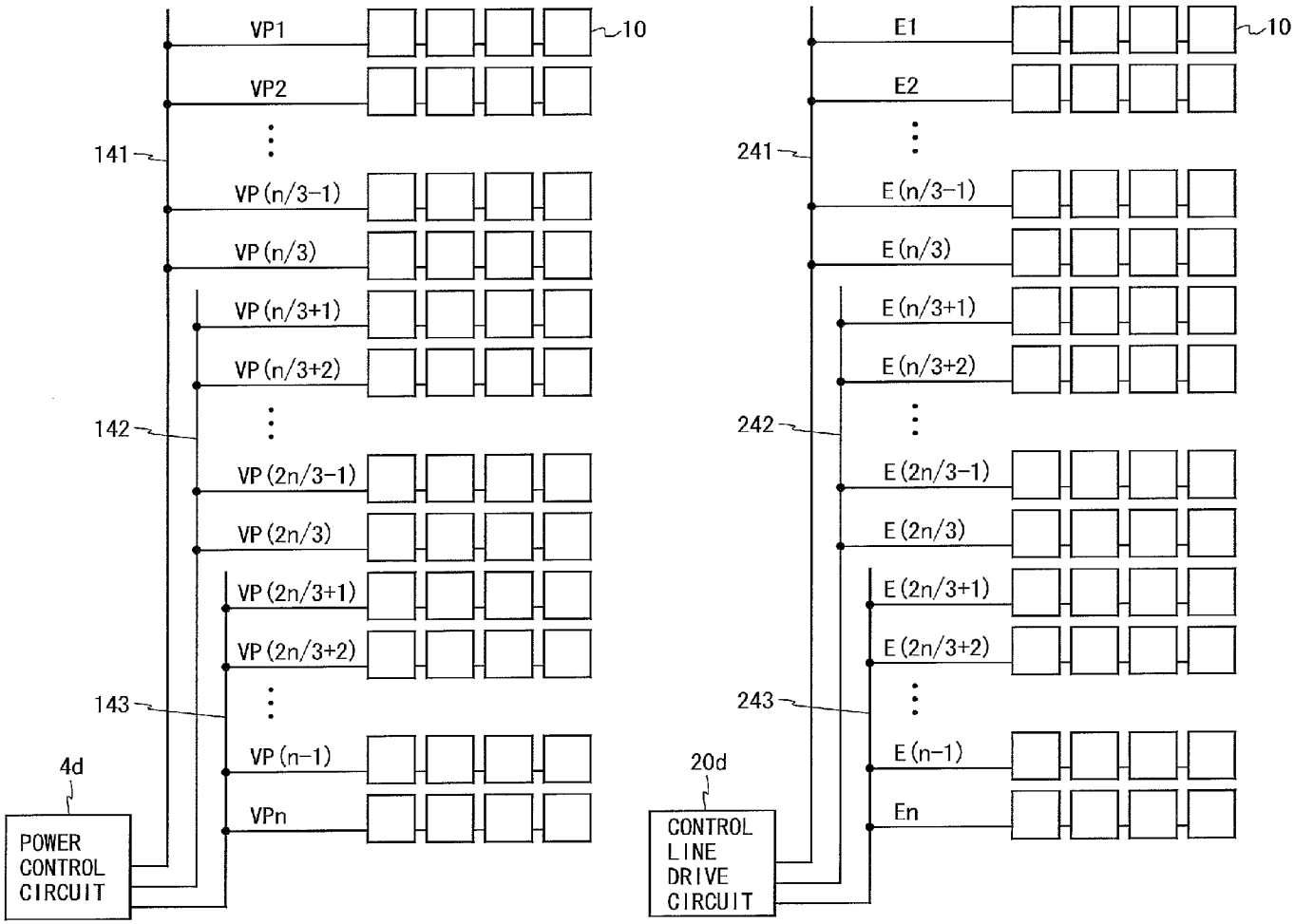
FIG. 22 is a diagram showing the connection forms of power lines and control lines in a third variant of the second embodiment.

FIG. 22 is a diagram showing the connection forms of power lines VPi and control lines Ei in a third variant of the second embodiment. In the present variant, a display device 200 is provided with three common power lines 141 to 143 to connect a power control circuit 4*d* to the power lines VPi, and is provided with three common control lines 241 to 243 to connect a control line drive circuit 20*d* to the control lines Ei. The respective one ends of the common power lines 141 to 143 are connected to three output terminals of the power control circuit 4*d*, respectively. Power lines VP1 to VP(n/3) are connected to the common power line 141, power lines VP(n/3+1) to VP(2n/3) are connected to the common power line 142, and power lines VP(2n/3+1) to VPn are connected to the common power line 143. The respective one ends of the common control lines 241 to 243 are connected to three output terminals of the control line drive circuit 20*d*, respectively. Control lines E1 to E(n/3) are connected to the common control line 241, control lines E(n/3+1) to E(2n/3) are connected to the common control line 242, and control lines E(2n/3+1) to En are connected to the common control line 243.

Figure 23:
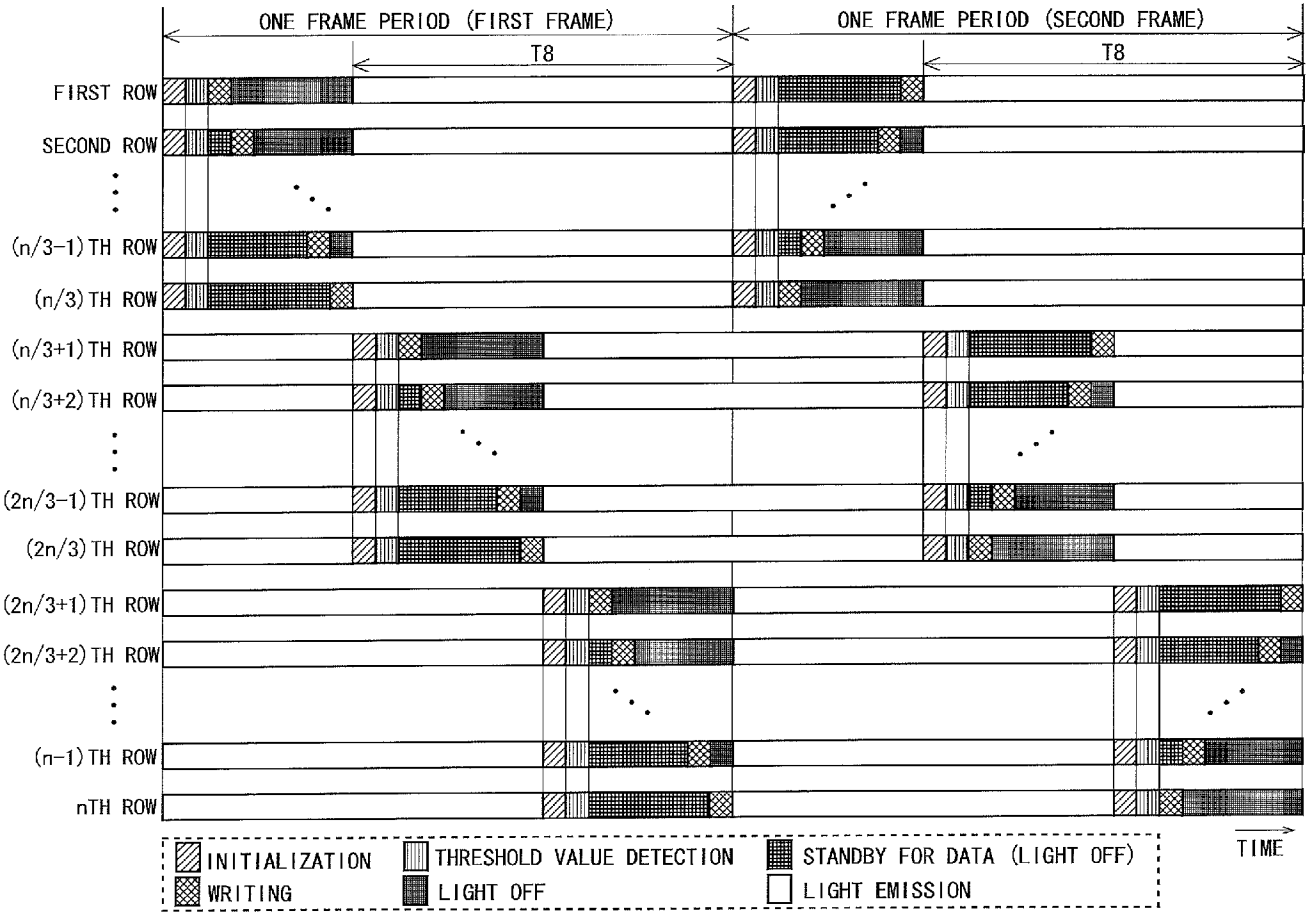
FIG. 23 is a diagram showing the operation of pixel circuits of each row in the third variant of the second embodiment.

FIG. 23 is a diagram showing the operation of pixel circuits 10 of each row in the present variant. In both of the first and second frames, pixel circuits 10 of the first to the (n/3)th row perform initialization and threshold value detection at the start of one frame period, pixel circuits 10 of the (n/3+1)th to the (2n/3)th row perform initialization and threshold value detection, delayed by a ⅓ frame period, and pixel circuits 10 of the (2n/3+1)th to the nth row perform initialization and threshold value detection, further delayed by a ⅓ frame period. Writing of the pixel circuits 10 on a row-by-row basis for the first to the (n/3)th row is performed in ascending order in the first frame and performed in descending order in the second frame. The same applies to the (n/3+1)th to the (2n/3)th row and the (2n/3+1)th to the nth row.

In the present variant, as shown in FIG. 23, in both of the first and second frames, all of the pixel circuits 10 of the first to the (n/3)th row start light emission at the same timing and complete the light emission at the same timing. In addition, all of the pixel circuits 10 of the (n/3+1)th to the (2n/3)th row start light emission at the same timing and complete the light emission at the same timing. Furthermore, all of the pixel circuits 10 of the (2n/3+1)th to the nth row start light emission at the same timing and complete the light emission at the same timing. The length T8 of a light emission period is equal for the pixel circuits 10 of all rows. It should be noted that, in the example shown in FIG. 23 the scanning speed of the pixel circuits 10 is the same as the normal one, and the length T8 of the light emission period of the pixel circuits 10 is about a ⅔ frame period.

According to the present variant, during a period in which pixel circuits 10 of rows belonging to a given row group perform initialization and threshold value detection, pixel circuits 10 of rows belonging to other two row groups emit light. As such, the length of the light emission period of each pixel circuit 10 is about a ⅔ frame period. That is, compared to a configuration in which one or two common power lines and one or two common control lines are provided, the light emission period can be increased.

2.5.4 Other Variants

The number q of the common control lines 21 may be 4 or more. When q≥4, the connection form of the control lines Ei and the operation of pixel circuits 10 of each row are the same as those described above. In addition, when q≥3, (n/q) control lines disposed adjacent to each other may be connected to the same common control line, or (n/q) control lines selected skipping every (q−1) lines may be connected to the same common control line. For example, when q=3, the configuration may be such that the control lines Ei are selected skipping every two lines, and control lines E1, E4, . . . are connected to a first common control line, control lines E2, E5, . . . are connected to a second common control line, and control lines E3, E6, . . . are connected to a third common control line.

3. Third Embodiment

3.1 Configuration

The overall configuration of a display device, the connection form of power lines VPi, and the configuration of pixel circuits 10 are the same as those of the first embodiment, and thus description thereof will be omitted (see FIGS. 2, 3, and 4).

3.2 Drive Method

Figure 24:
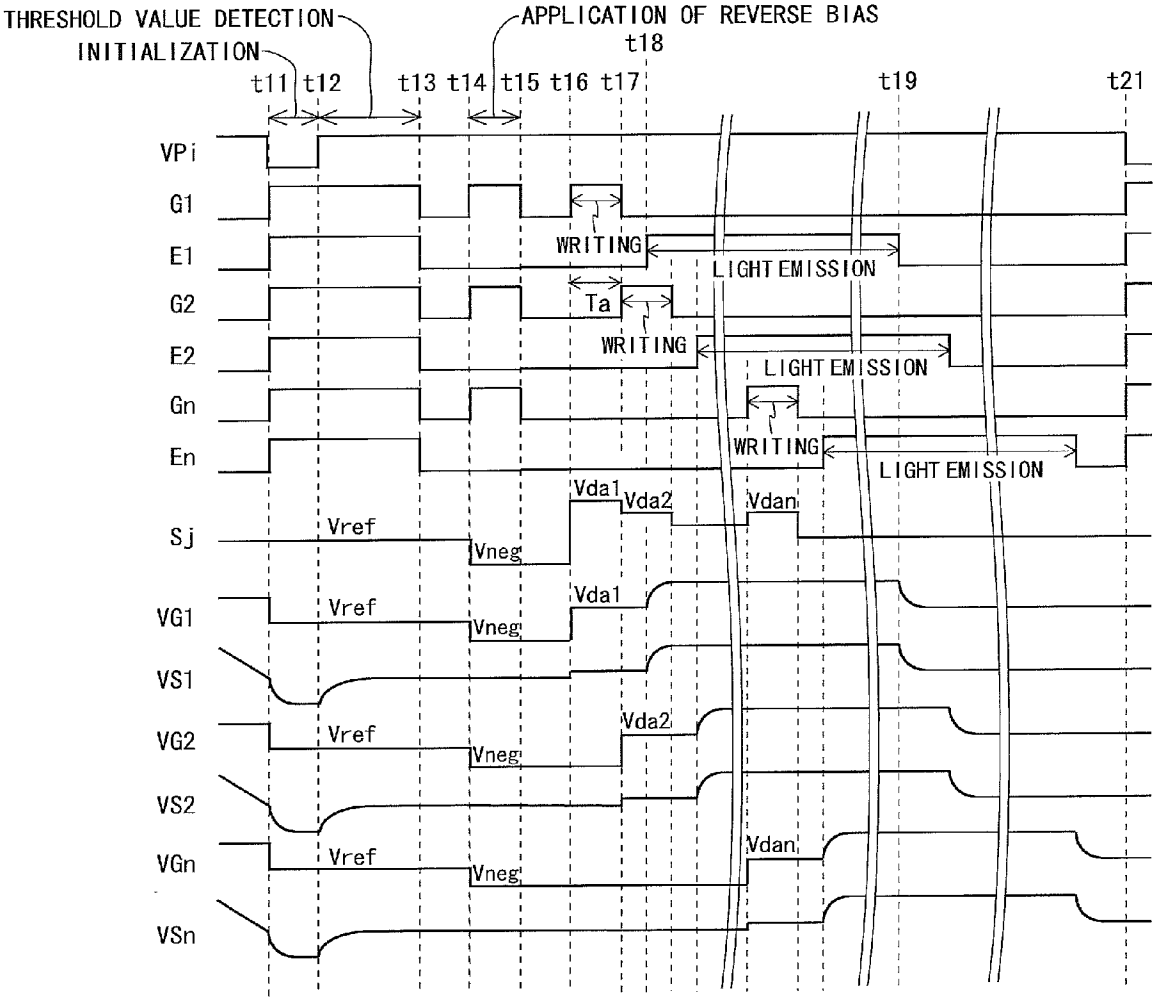
FIG. 24 is a timing chart (first frame) showing a method of driving pixel circuits in a third embodiment of the present invention.
Figure 25:
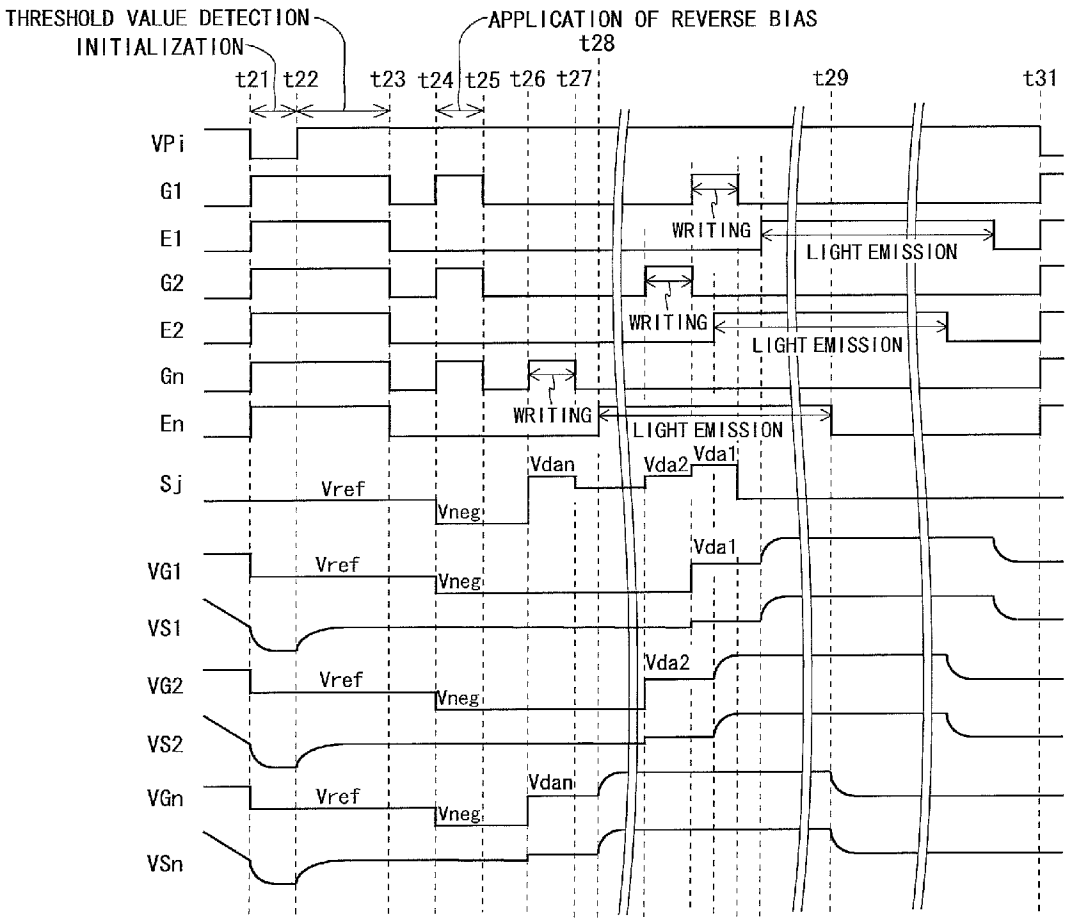
FIG. 25 is a timing chart (second frame) showing a method of driving the pixel circuits in the third embodiment.

FIGS. 24 and 25 are timing charts showing a method of driving the pixel circuits 10 in the present embodiment. As shown in FIGS. 24 and 25, in the present embodiment, in both of the first and second frames, during the period from the time of completion of threshold value detection in the pixel circuits 10 of all rows until the time when writing in pixel circuits 10 of each row starts, a reverse bias (negative bias) is applied to the gates of TFTs 12 at the same time (see time t14 to t15 in FIG. 24 and time t24 to t25 in FIG. 25), in the pixel circuits 10 of all rows. The application of a reverse bias to the gates of the TFTs 12 is specifically performed by applying a sufficiently low potential Vneg to data lines Sj with the potentials of all scanning signal lines Gi set to a high level. It should be noted that, in the pixel circuits 10 of each row, a reverse bias is continuously applied to the gates of the TFTs 12 throughout the period until writing starts. Operation other than the application of the reverse bias to the gates of the TFTs 12 is the same as that of the first embodiment, and thus description thereof will be omitted.

Figure 26:
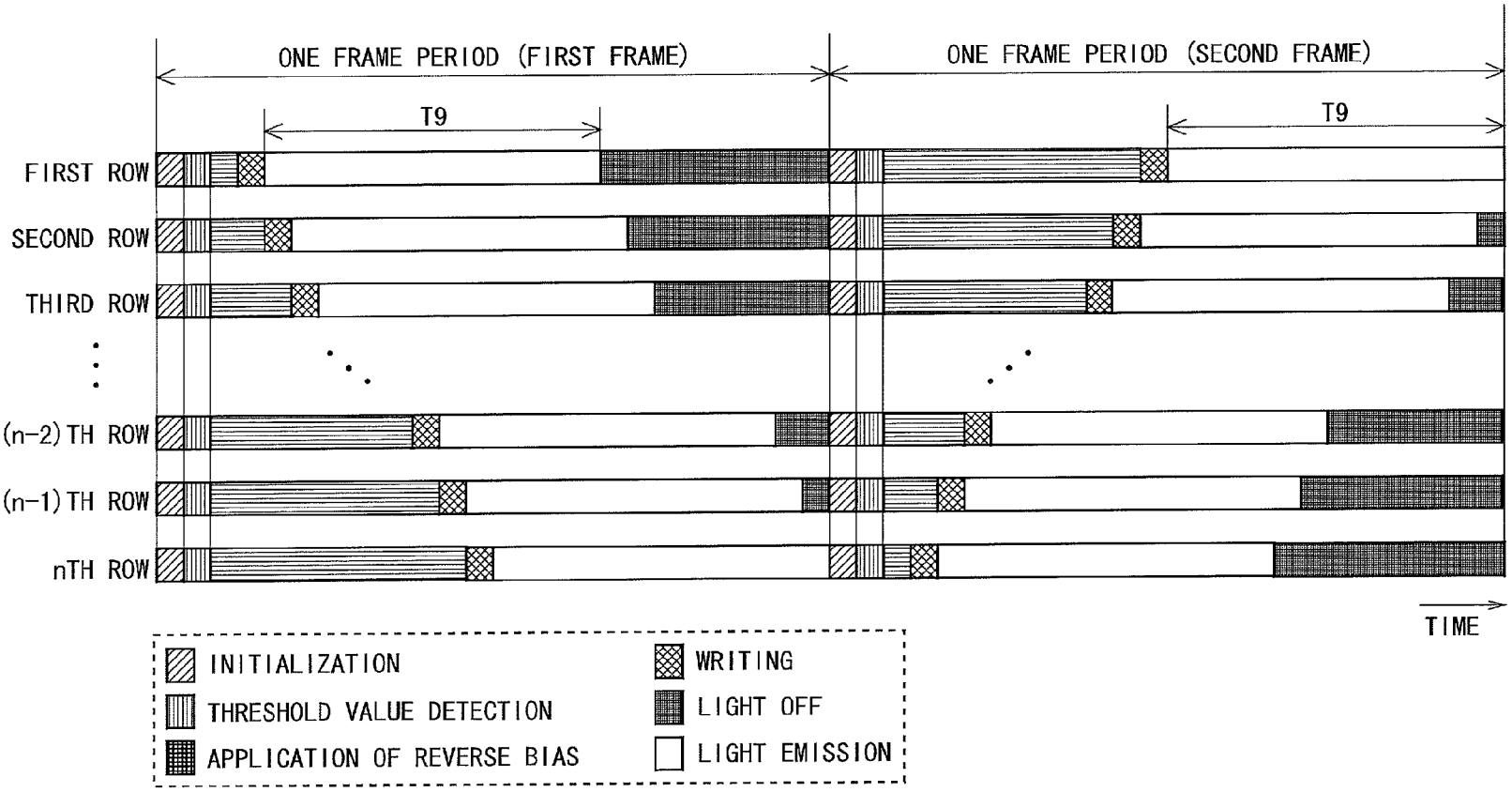
FIG. 26 is a diagram showing the operation of pixel circuits of each row in the third embodiment.

FIG. 26 is a diagram showing the operation of pixel circuits 10 of each row in the present embodiment. In both of the first and second frames, the pixel circuits 10 of all rows perform initialization at the start of one frame period, and then perform threshold value detection, and then perform reverse bias application to the gates of the TFTs 12. The reverse bias application continues for a period until writing starts in pixel circuits 10 of each row. In the first frame, after application of the reverse bias, the writing and light emission of the pixel circuits 10 on a row-by-row basis are performed in ascending order. In the second frame, after application of the reverse bias, the writing and light emission of the pixel circuits 10 on a row-by-row basis are performed in descending order. It should be noted that, in both of the first and second frames, pixel circuits 10 of each row emit light for a fixed time period T9, and turn their light off during other periods.

3.3 Effects

In general, as for a TFT (Thin Film Transistor), it is known that "the threshold characteristic shifts in a positive direction when a positive bias is applied to the gate, and the threshold characteristic sits in a negative direction when a reverse bias (negative bias) is applied to the gate". Note that the phrase "the threshold characteristic shifts in a positive direction" means that "the Id (drain current)−Vg (gate voltage) characteristic shifts rightward". In a display device including self-luminous type display elements, normally, during a period in which light is emitted, a positive voltage is applied between the gate and source of a driving transistor (TFT 12). Hence, with the accumulation of light emission times, the threshold characteristic of the driving transistor gradually shifts in a positive direction. In this regard, according to the present embodiment, in each pixel circuit 10, a reverse bias is applied to the gate of the TFT 12 during the period from the time of completion of threshold value detection until the time when writing starts. Hence, a shift (in the positive direction) in the threshold characteristic of the TFT 12 functioning as a driving transistor is suppressed. In addition, since the scanning order is reversed every frame, the cumulative time during which the reverse bias is applied to the gate of the TFT 12 becomes substantially equal for the pixel circuits 10 of all rows. By this, a shift in the threshold characteristic of the TFT 12 is suppressed without causing variations between rows. Note that during a period in which the reverse bias is applied to the gate of the TFT 12, the TFT 12 is maintained in an off state, and thus the movement of charge from the source of the TFT 12 does not occur. Therefore, in the TFT 12, while the reverse bias is applied to the gate, a threshold value can be continuously held in the source.

3.4 Variants

Figure 27:
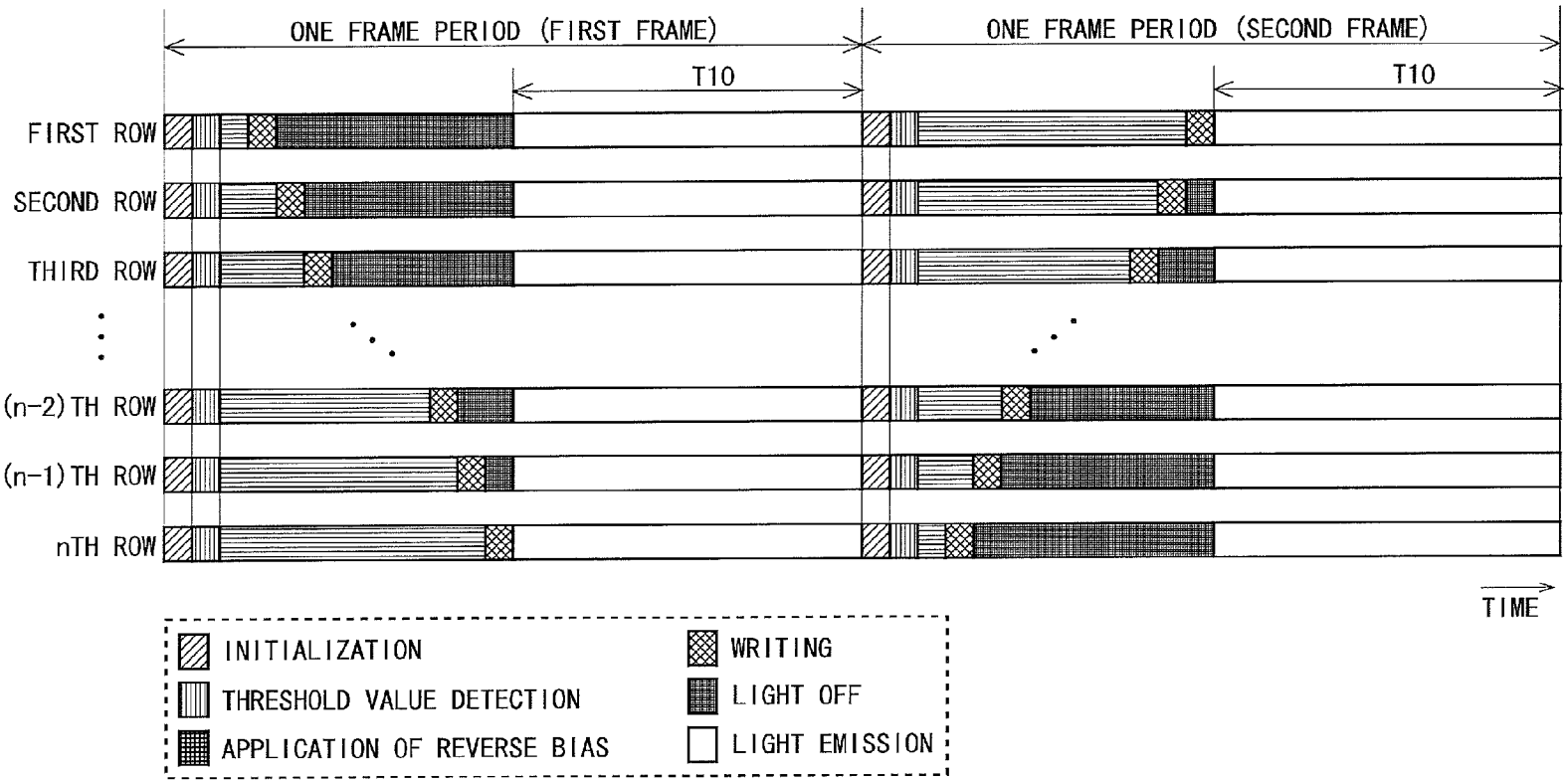
FIG. 27 is a diagram showing the operation of pixel circuits of each row in a variant of the third embodiment.
Figure 28:
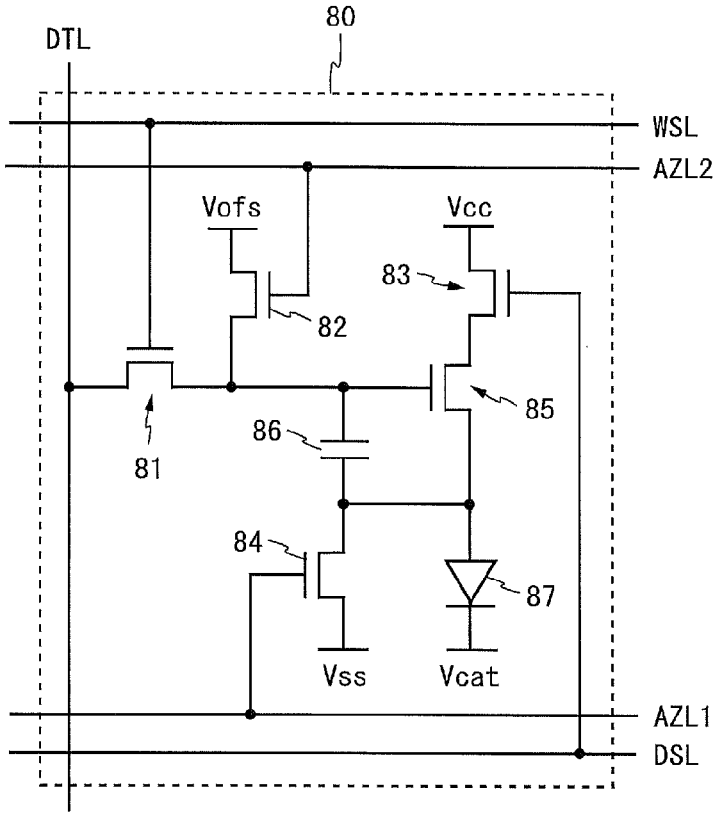
FIG. 28 is a circuit diagram of a pixel circuit included in a conventional display device.
Figure 29:
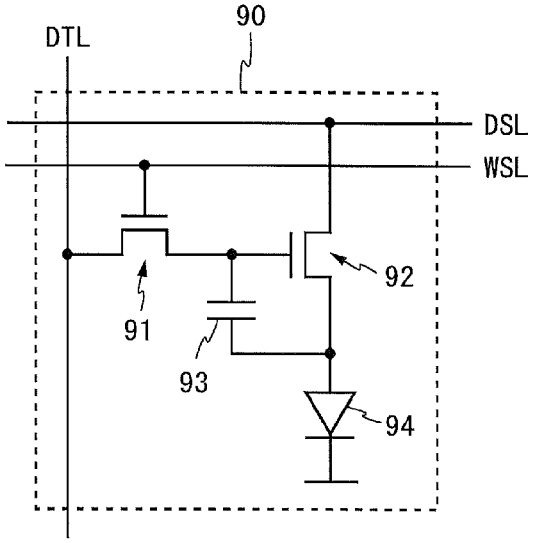
FIG. 29 is a circuit diagram of a pixel circuit included in another conventional display device.

FIG. 27 is a diagram showing the operation of pixel circuits 10 of each row in a variant of the third embodiment. By a configuration in which n control lines Ei are collectively driven as in the second embodiment, the pixel circuits 10 of all rows may simultaneously emit light for a fixed time period T10 as shown in FIG. 27. In addition, as in the first to third variants of the first and second embodiments, the configuration may be such that power lines VPi and control lines Ei are divided into a plurality of groups, and the power lines VPi and the control lines Ei are driven on a group-by-group basis.

4. Others

Although in the above-described embodiments an organic EL display is described as an example, the present invention is not limited thereto. The present invention can also be applied to display devices other than organic EL displays as long as the display devices include current-driven self-luminous type display elements.

DESCRIPTION OF REFERENCE CHARACTERS

1: DISPLAY CONTROL CIRCUIT
2: GATE DRIVER CIRCUIT
3: SOURCE DRIVER CIRCUIT
4, 4*a*, 4*b*, 4*c*, and 4*d*: POWER CONTROL CIRCUIT
5: SHIFT REGISTER
6: REGISTER
7: LATCH CIRCUIT
8: D/A CONVERTER
9: COMMON POWER LINE
10: PIXEL CIRCUIT
11: TFT (WRITE CONTROL TRANSISTOR)
12: TFT (DRIVING TRANSISTOR)
13: TFT (LIGHT EMISSION CONTROL TRANSISTOR)
15: CAPACITOR
16: ORGANIC EL ELEMENT (ELECTRO-OPTIC ELEMENT)
20, 20*a*, 20*b*, 20*c*, and 20*d*: CONTROL LINE DRIVE CIRCUIT
21: COMMON CONTROL LINE
100 and 200: DISPLAY DEVICE
Gi: SCANNING SIGNAL LINE
Ei: CONTROL LINE
Sj: DATA LINE
VPi: POWER LINE

The invention claimed is:

1. An active matrix-type display device comprising:
a plurality of pixel circuits arranged to form a matrix having a plurality of rows and a plurality of columns;
a plurality of video signal lines provided for the respective columns of the plurality of pixel circuits;
a plurality of scanning signal lines and a plurality of control lines provided for the respective rows of the plurality of pixel circuits;
a plurality of power lines provided to supply a power supply potential to the plurality of pixel circuits;
a column drive circuit that drives the plurality of video signal lines; and
a row drive circuit that drives the plurality of scanning signal lines and the plurality of control lines selectively or collectively, wherein
each of the pixel circuits includes:
an electro-optic element that emits light based on a current provided from the power line;
a driving transistor provided on a path of the current flowing through the electro-optic element;
a write control transistor that is provided between a control terminal of the driving transistor and the video signal line, and that electrically connects the control terminal of the driving transistor to the video signal line when the scanning signal line is activated by the row drive circuit;
a light emission control transistor that is provided between one conduction terminal of the driving transistor and the power line, and that electrically connects the one conduction terminal of the driving transistor to the power line when the control line is activated by the row drive circuit; and
a capacitor provided between the control terminal of the driving transistor and the other conduction terminal of the driving transistor, and
when focusing on each row group obtained when the plurality of rows are grouped into one or a plurality of row groups, the row drive circuit collectively activates all of scanning signal lines and control lines provided for respective rows belonging to the row group during an initialization period and a threshold value detection period, and selectively and sequentially activates the scanning signal lines provided for the respective rows belonging to the row group while selection order is reversed every k-frame period (k is a natural number), such that a write period for accumulating in the capacitors charge according to an image to be displayed is provided on a row-by-row basis, after the threshold value detection period, the initialization period being a predetermined period of time after start of a frame period and being a period for initializing the electro-optic element, and the threshold value detection period being a predetermined period of time after the initialization period and being a period for compensating for variations in the threshold voltage of the driving transistor.

2. The display device according to claim 1, wherein the k is 1.

3. The display device according to claim 1, further comprising:
a power control circuit that drives the plurality of power lines; and
for each of the row groups, a common power line connected in a shared manner to a group of the plurality of power lines, wherein
when focusing on each row group, the power control circuit provides an initialization potential, through a common power line corresponding to the row group, to power lines connected to the common power line during the initialization period, the initialization potential initializing the electro-optic element.

4. The display device according to claim 3, wherein the plurality of rows are grouped into a plurality of row groups.

5. The display device according to claim 4, wherein the plurality of rows are grouped such that a plurality of power lines belonging to a same row group are not adjacent to each other.

6. The display device according to claim 4, wherein the plurality of rows are grouped into three or more row groups.

7. The display device according to claim 1, further comprising, for each of the row groups, a common control line connected in a shared manner to a group of the plurality of control lines, wherein
when focusing on each row group, the row drive circuit activates a common control line corresponding to the row group, such that electro-optic elements in pixel circuits of all rows belonging to the row group emit light at same timing after completion of a write period for all rows belonging to the row group.

8. The display device according to claim 7, wherein the plurality of rows are grouped into one row group.

9. The display device according to claim 7, wherein the plurality of rows are grouped into a plurality of row groups.

10. The display device according to claim 7, further comprising:

a power control circuit that drives the plurality of power lines; and for each of the row groups, a common power line connected in a shared manner to a group of the plurality of power lines, wherein when focusing on each row group, the power control circuit provides an initialization potential, through a common power line corresponding to the row group, to power lines connected to the common power line during the initialization period, the initialization potential initializing the electro-optic element.

11. The display device according to claim 10, wherein the plurality of rows are grouped into a plurality of row groups.

12. The display device according to claim 11, wherein the plurality of rows are grouped such that a plurality of power lines belonging to a same row group are not adjacent to each other.

13. The display device according to claim 11, wherein the plurality of rows are grouped into three or more row groups.

14. The display device according to claim 1, wherein when focusing on each row group, during a period after the threshold value detection period and before a first write period for rows belonging to the row group starts, the row drive circuit collectively activates all scanning signal lines provided for the respective rows belonging to the row group, and the column drive circuit applies a reverse bias potential to the plurality of video signal lines, the reverse bias potential placing the driving transistor in a reverse bias state.

15. A drive method for an active matrix-type display device including a plurality of pixel circuits arranged to form a matrix having a plurality of rows and a plurality of columns; a plurality of video signal lines provided for the respective columns of the plurality of pixel circuits; a plurality of scanning signal lines and a plurality of control lines provided for the respective rows of the plurality of pixel circuits; and a plurality of power lines provided to supply a power supply potential to the plurality of pixel circuits, the method comprising:

a column driving step of driving the plurality of video signal lines; and a row driving step of driving the plurality of scanning signal lines and the plurality of control lines selectively or collectively, wherein each of the pixel circuits includes:

an electro-optic element that emits light based on a current provided from the power line;

a driving transistor provided on a path of the current flowing through the electro-optic element;

a write control transistor that is provided between a control terminal of the driving transistor and the video signal line, and that electrically connects the control terminal of the driving transistor to the video signal line when the scanning signal line is activated in the row driving step;

a light emission control transistor that is provided between one conduction terminal of the driving transistor and the power line, and that electrically connects the one conduction terminal of the driving transistor to the power line when the control line is activated in the row driving step; and a capacitor provided between the control terminal of the driving transistor and the other conduction terminal of the driving transistor, and when focusing on each row group obtained when the plurality of rows are grouped into one or a plurality of row groups, in the row driving step, all of scanning signal lines and control lines provided for respective rows belonging to the row group are collectively activated during an initialization period and a threshold value detection period, and the scanning signal lines provided for the respective rows belonging to the row group are selectively and sequentially activated while selection order is reversed every k-frame period (k is a natural number), such that a write period for accumulating in the capacitors charge according to an image to be displayed is provided on a row-by-row basis, after the threshold value detection period, the initialization period being a predetermined period of time after start of a frame period and being a period for initializing the electro-optic element, and the threshold value detection period being a predetermined period of time after the initialization period and being a period for compensating for variations in the threshold voltage of the driving transistor.

16. The drive method according to claim 15, wherein the k is 1.

17. The drive method according to claim 15, wherein when focusing on each row group, during a period after the threshold value detection period and before a first write period for rows belonging to the row group starts, in the row driving step, all scanning signal lines provided for the respective rows belonging to the row group are collectively activated, and in the column driving step, a reverse bias potential is applied to the plurality of video signal lines, the reverse bias potential placing the driving transistor in a reverse bias state.

* * * * *